US008307791B2

(12) United States Patent
Sugiura

(10) Patent No.: US 8,307,791 B2
(45) Date of Patent: Nov. 13, 2012

(54) FOUR-CYCLE AIR-OIL COOLED ENGINE, AND VEHICLE INCORPORATING SAME

(75) Inventor: Hiroyuki Sugiura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 684 days.

(21) Appl. No.: 12/584,603

(22) Filed: Sep. 9, 2009

(65) Prior Publication Data

US 2010/0065011 A1 Mar. 18, 2010

(30) Foreign Application Priority Data

Sep. 17, 2008 (JP) ..... 2008-237625

(51) Int. Cl.
*F01P 1/10* (2006.01)

(52) U.S. Cl. ..... 123/41.32; 123/41.57; 123/41.62; 123/41.7; 123/41.82 R

(58) Field of Classification Search ..... 123/41.58, 123/41.57, 41.52, 41.33, 41.32, 41.3, 198 E, 123/195 C, 193.5, 41.62, 41.61, 41.59, 41.7, 123/41.82 R
See application file for complete search history.

(56) References Cited

U.S. PATENT DOCUMENTS

| | | | | |
|---|---|---|---|---|
| 1,914,940 | A * | 6/1933 | Chilton | 123/169 C |
| 1,947,221 | A * | 2/1934 | Niven | 123/41.67 |
| 2,236,762 | A * | 4/1941 | Ottofy | 123/169 C |
| 4,644,910 | A * | 2/1987 | Kawamura | 123/41.31 |
| 4,688,523 | A | 8/1987 | Takahashi et al. | |
| 6,988,573 | B2 * | 1/2006 | Tsuruta et al. | 180/68.1 |
| 7,337,755 | B2 * | 3/2008 | Gokan et al. | 123/41.01 |
| 2006/0065218 | A1 * | 3/2006 | Gokan et al. | 123/41.82 R |
| 2008/0017026 | A1 | 1/2008 | Dondlinger et al. | |
| 2010/0223915 | A1 * | 9/2010 | Sugiura | 60/287 |

FOREIGN PATENT DOCUMENTS

| | | | |
|---|---|---|---|
| EP | 0 175 300 A2 | | 3/1986 |
| JP | 2-22621 | | 2/1990 |
| JP | 2006233783 | * | 9/2006 |

* cited by examiner

*Primary Examiner* — Noah Kamen
*Assistant Examiner* — Hung Q Nguyen
(74) *Attorney, Agent, or Firm* — Carrier Blackman & Associates, P.C.; Joseph P. Carrier; William D. Blackman

(57) ABSTRACT

A four-cycle air-oil cooled engine includes a cylinder head having a spark plug mounting hole formed therein, and a ring-like groove formed therein and surrounding the spark plug mounting hole. The cylinder head is formed with first and second co-planar sealing surfaces, disposed on a plane perpendicular to an axis of the spark plug mounting hole, and having an opening end of the ring-like groove disposed therebetween. The ring-like groove defines an oil jacket around the periphery of the spark plug mounting hole. A cover member having a flat surface opposed to the first and second flat sealing surfaces of the cylinder head is secured to the cylinder head such that a single gasket is interposed between the first and second sealing surfaces and the flat surface of the cover member.

20 Claims, 16 Drawing Sheets

FOUR-CYCLE AIR-OIL COOLED ENGINE, AND VEHICLE INCORPORATING SAME

CROSS-REFERENCE TO RELATED APPLICATIONS

The present invention claims priority under 35 USC 119 based on Japanese patent application No. 2008-237625, filed on Sep. 17, 2008. The entire subject matter of this priority document, including specification claims and drawings thereof, is incorporated by reference herein.

BACKGROUND OF THE INVENTION

1. Field of the Invention

The present invention relates to an air-oil cooled engine, and to a vehicle incorporating the air-oil cooled engine. More particularly, the present invention relates to a four-cycle air-oil cooled engine including a cylinder head having a spark plug mounting hole formed therein and a ring-like groove surrounding the spark plug mounting hole. The spark plug mounting hole is adapted to receive a spark plug therein. The engine also includes a cover member for closing an opening end of the groove defining an oil jacket disposed around a periphery of the spark plug mounting hole; and a gasket disposed between the cylinder head and the cover member secured to the cylinder head; and to a vehicle (motorcycle) incorporating the same.

2. Description of the Background Art

There are a number of known four-cycle air-oil cooled engines. For example, the Japanese Utility Model Laid-open No. Hei 2-22621 discloses a four-cycle air-oil cooled engine, in which an annular groove provided on the periphery of a spark plug is covered with a cover member provided on the cylinder head for defining an oil jacket on the periphery of a spark plug mounting hole.

The four-cycle air-oil cooled engine disclosed in Japanese Utility Model Laid-open No. Hei 2-22621 is configured as discussed herein. The cylinder head is provided with cylindrical columnar portions, which are coaxial with corresponding respective spark plug mounting holes. The cover member is arranged such that a first annular gasket, disposed inward of the groove, is interposed between the upper surface of the cylinder head and the cover member, and a second annular gasket, disposed outward of the groove, is interposed between the inner circumferential surface of the columnar portion and the cover member.

Also in the four-cycle air-oil cooled engine disclosed in Japanese Utility Model Laid-open No. Hei 2-22621, the spark plug threadably engaged with the spark plug mounting hole, and the cover member is sandwiched between the cylinder head and the spark plug. Thus, two gaskets are needed, which increases the number of component parts required, and makes sealing surfaces complicated. Such a complicated sealing arrangement makes it difficult to ensure sealing performance.

In addition, during the assembly of the cover member, it is difficult to assemble the two gaskets, one of which is interposed between the upper surface of the cylinder head and the cover member, and the other of which is interposed between the inner circumferential surface of the columnar portion and the cover member. This requires improved assembly performance.

The present invention has been made to overcome such drawbacks of existing four-cycle air-oil cooled engines. Accordingly, it is one of the objects of the present invention to provide a four-cycle air-oil cooled engine that improves sealing performance and enhances assembly performance, while simplifying a sealing structure between a cylinder head and a cover member used to define an oil jacket.

SUMMARY OF THE INVENTION

In order to achieve the above objects, the present invention according to a first aspect thereof is characterized in that in a four-cycle air-oil cooled engine includes a cylinder head of an engine body having a spark plug mounting hole formed therein, and a ring-like groove formed therein surrounding the spark plug mounting hole, the spark plug mounting hole being adapted to attach a spark plug thereto. The engine also includes a cover member, which closes an opening end of the groove, defining an oil jacket disposed on the periphery of the spark plug mounting hole between the cylinder head and the cover member. The cover member is secured to the cylinder head so as to be formed like a ring surrounding the spark plug.

The cylinder head is formed with first and second flat sealing surfaces, disposed on the same plane perpendicular to an axis of the spark plug mounting hole so as to put an opening end of the groove between the inside and outside, and the cover member having a flat surface opposed to the first and second sealing surfaces is secured to the cylinder head in such a manner as to interpose a gasket between the first and second sealing surfaces and the flat surface.

The present invention according to a second aspect thereof, in addition to the first aspect, is characterized in that the cover member is fastened to the cylinder head by means of a special fastening member.

The present invention according to a third aspect thereof, in addition to one of the first and second aspects, is characterized in that a cylindrical connecting portion is integrally continuously provided at both ends with a pair of the cover members disposed for each pair of cylinders adjacent to each other, the cylindrical connecting portion forming a communicating passage connecting between the oil jackets for each pair of cylinders.

The present invention according to a fourth aspect thereof, in addition to the third aspect, is characterized in that the cylinder head having a first sidewall bored with an intake port, and a second sidewall opposed to the first sidewall, and bored with an exhaust port is provided with the spark plug mounting hole located between the first and second sidewalls, and the cylindrical connecting portion is disposed at a position offset from the center of the cover member toward the first sidewall.

The present invention according to a fifth aspect thereof, in addition to one of the third and fourth aspects, is characterized in that a plurality of cooling fins whose at least part is disposed at a portion overlapping the communicating passage, when viewed in a top view, are integrally formed on the cover member.

The present invention according to a sixth aspect thereof, in addition to the fifth aspect, is characterized in that the cooling fins are each respectively disposed at an incline with respect to the front-rear (longitudinal) direction of the vehicle in such a manner as to take an outer position as the cooling fin goes toward the rearward of the vehicle, in a state where the engine body is mounted on the vehicle in a posture where a cylinder arrangement direction takes a right-left direction.

The present invention according to a seventh aspect thereof, in addition to one of the third through sixth aspects, is characterized in that a plug attachment concave portion opening at least upwardly, and adapted to dispose the spark plug therein is provided on an upper portion of the cylinder head and on a head cover joined to the cylinder head, and an air-guide plate adapted to lead running-air to the periphery of the spark plug is provided integrally with an integrally continuous metallic gasket so as to extend above the plug attachment concave portion and toward the front. The gasket is interposed between the cylinder head and the pair of cover members disposed inside the plug attachment concave portion for each pair of cylinders adjacent to each other.

In the illustrative embodiments of the present invention, bolt(s) corresponds to a fastening member of the present invention.

EFFECTS OF THE INVENTION

According to the first aspect of the present invention, the cylinder head is formed with the first and second flat sealing surfaces, disposed on the same plane perpendicular to an axis of the spark plug mounting hole so as to put an opening end of the groove between the inside and outside, and the cover member is secured to the cylinder head in such a manner as to interpose a gasket between the first and second sealing surfaces and the flat surface. Therefore, a gap between the cover member and the cylinder head can be sealed internally of and externally of the groove by the sealing structure simply configured by use of a single gasket. Accordingly, while simplifying the sealing structure and ensuring sealing performance, assembling performance can be enhanced.

According to the second aspect of the present invention, the cover member is fastened to the cylinder head by using the special fastening member. Therefore, the sealing performance can constantly be maintained without being affected by the removal of the spark plug, compared with the conventional structure where the cover member is gripped between the spark plug and the cylinder head.

According to the third aspect of the present invention, since the pair of cover members are united via the connecting cylindrical portion, the assembly man-hours can be reduced while reducing the number of component parts.

According to the fourth aspect of the present invention, since the cylindrical connecting portion is disposed at a position offset from the center of the cover member toward the first sidewall, i.e., toward the side opposite the exhaust port, it is possible to prevent (or minimize the exposure of) the communicating passages from being subjected to a thermal influence from the side of the exhaust port.

According to the fifth aspect of the present invention, the cooling fins having at least a portion thereof disposed at a portion overlapping the communicating passage, when viewed in a top view, are integrally formed on the cover member. Therefore, oil passing through the connecting passage can effectively be cooled.

According to the sixth aspect of the present invention, the cooling fins are each inclined with respect to the front-rear direction of the vehicle in such a manner as to take an outer position as it goes toward the rearward of the vehicle, in the state where the engine body is mounted on the vehicle. Therefore, running-air flowing along the sides of the cooling fins during the traveling operation of the motorcycle is allowed to flow along the external side of the engine body. This can prevent heat from staying on the central side of the engine body.

According to the seventh aspect of the present invention, the metallic gasket interposed between the cylinder head and each of the pair of cover members disposed in the plug attachment concave portion for each pair of cylinders adjacent to each other is formed integrally continuously with each other. This contributes to a reduction in the number of component parts.

In addition, the air-guide plate adapted to lead running-air to the periphery of the spark plug is provided integrally with the gasket so as to extend above the plug attachment concave portion and toward the front. Therefore, while avoiding or minimizing an increase in the number of component parts, the spark plug and the periphery thereof can be cooled.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Mode for carrying out the present invention is hereinafter described based on illustrative embodiments of the present invention with reference to the accompanying drawings.

Figure 1:
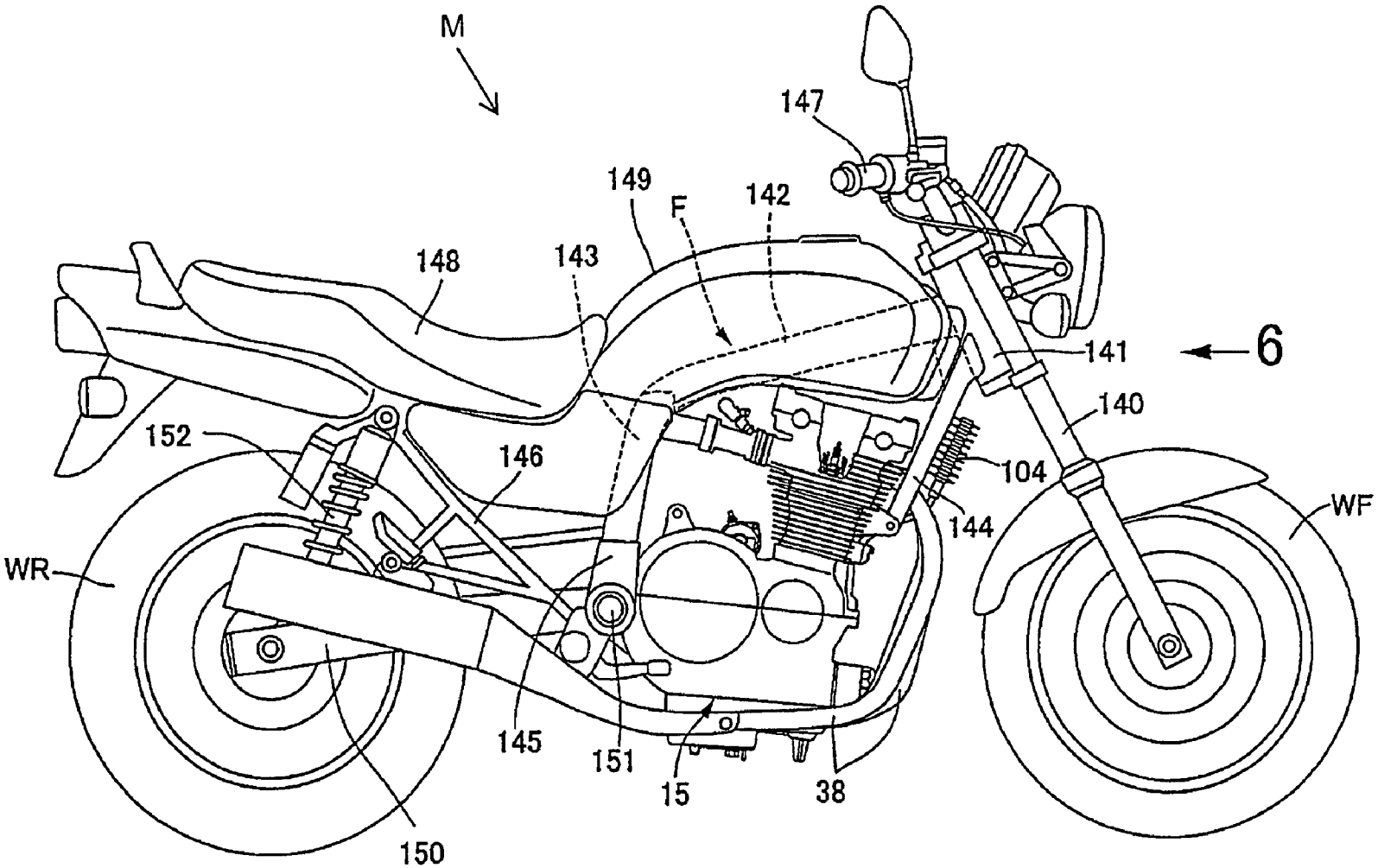
FIG. 1 is a right side lateral view of a motorcycle according to a first illustrative embodiment of the present invention.
Figure 2:
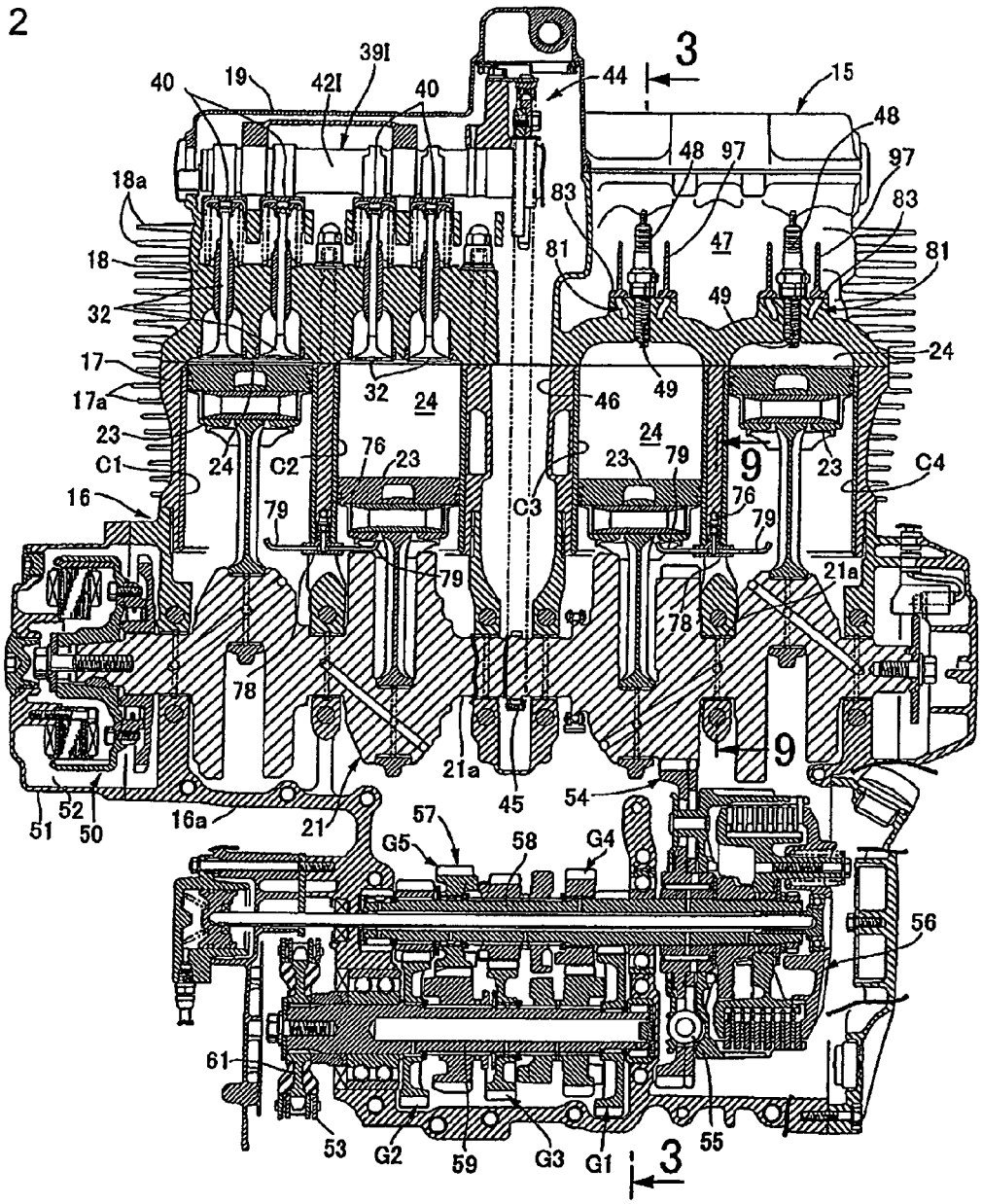
FIG. 2 is a longitudinal cross-sectional view of a four-cycle air-oil cooled engine, taken along line 2-2 of FIG. 3.
Figure 3:
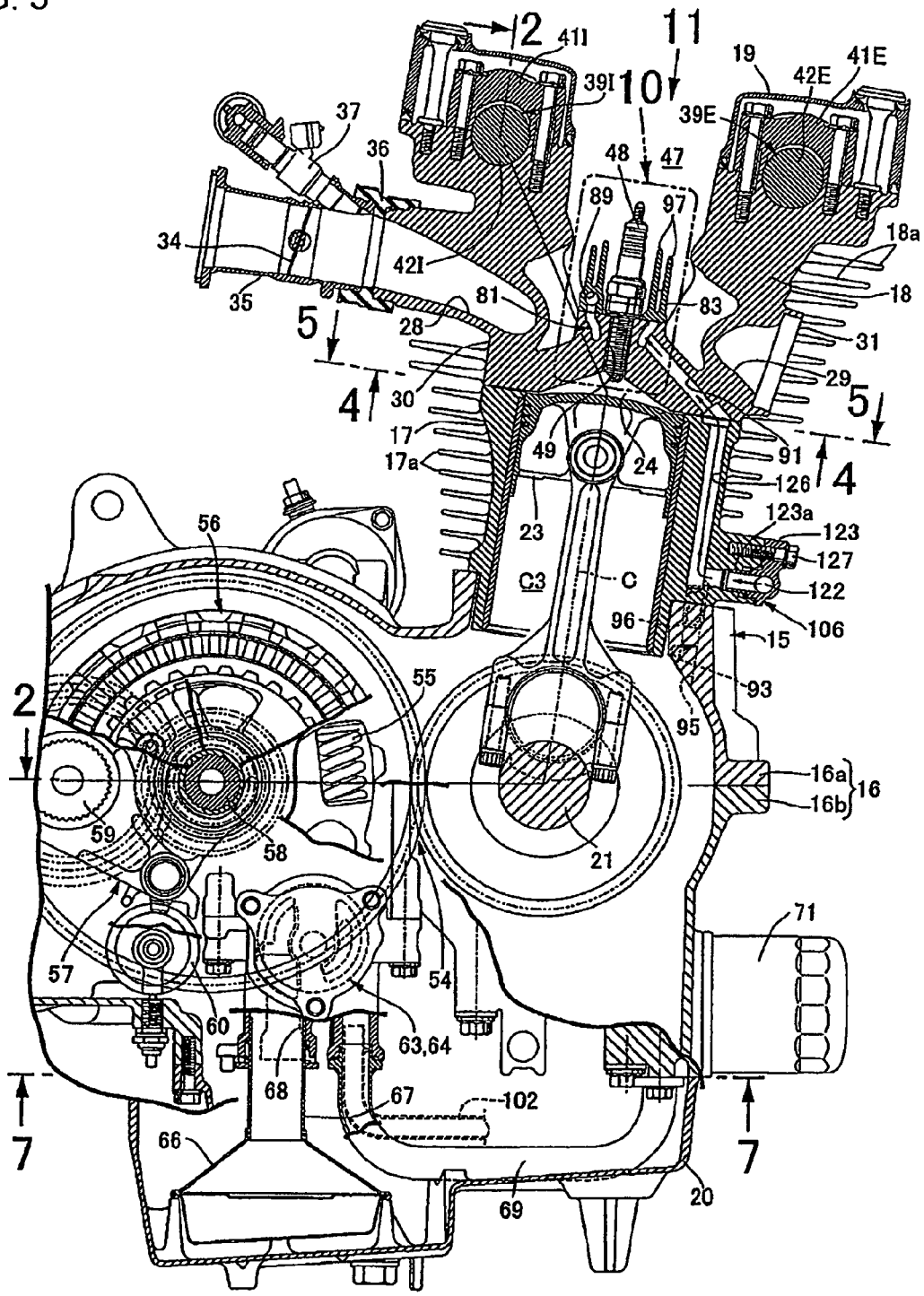
FIG. 3 is a cross-sectional view taken along line 3-3 of FIG. 2.
Figure 4:
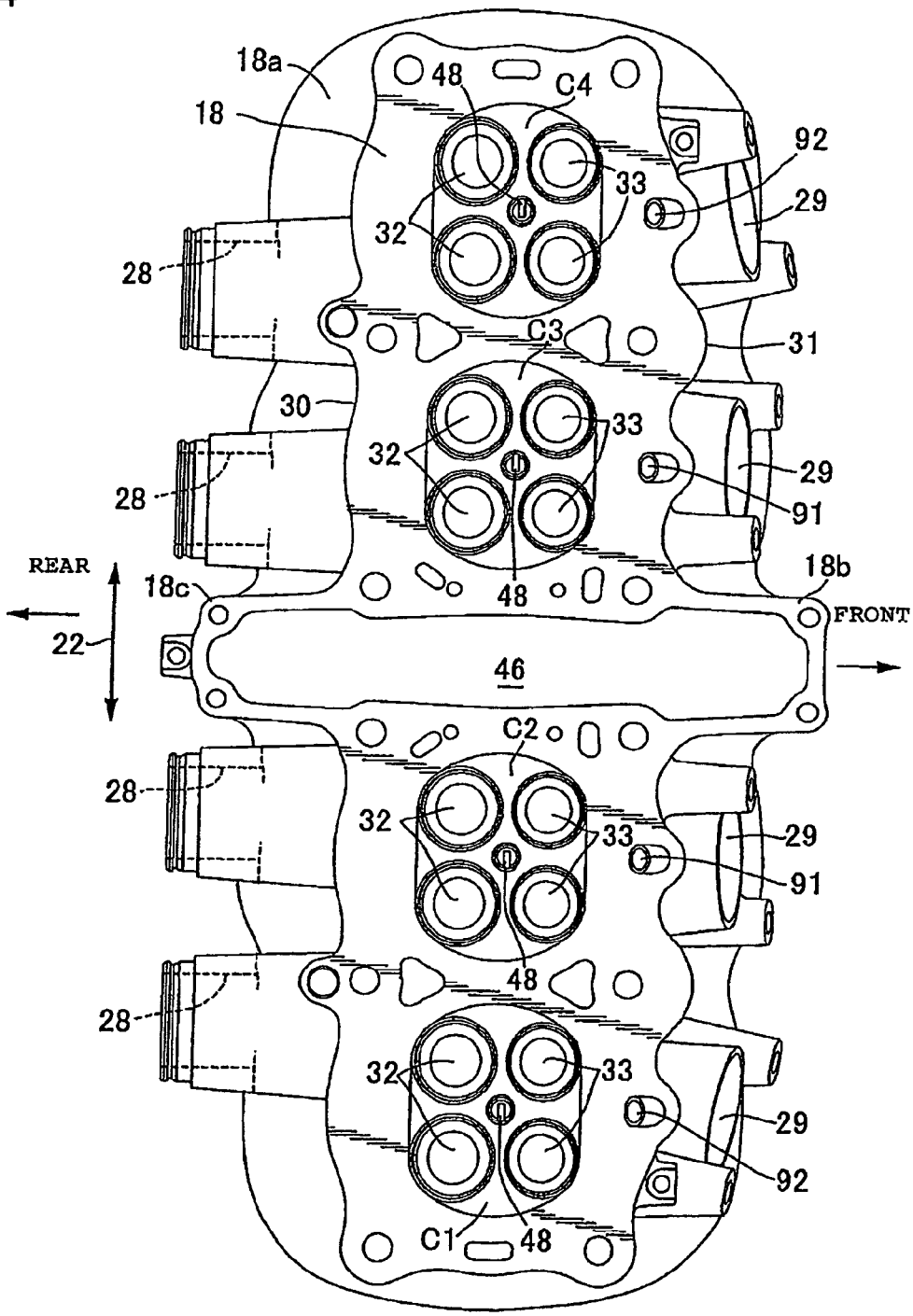
FIG. 4 is a view as viewed along arrows 4-4 in FIG. 3.
Figure 5:
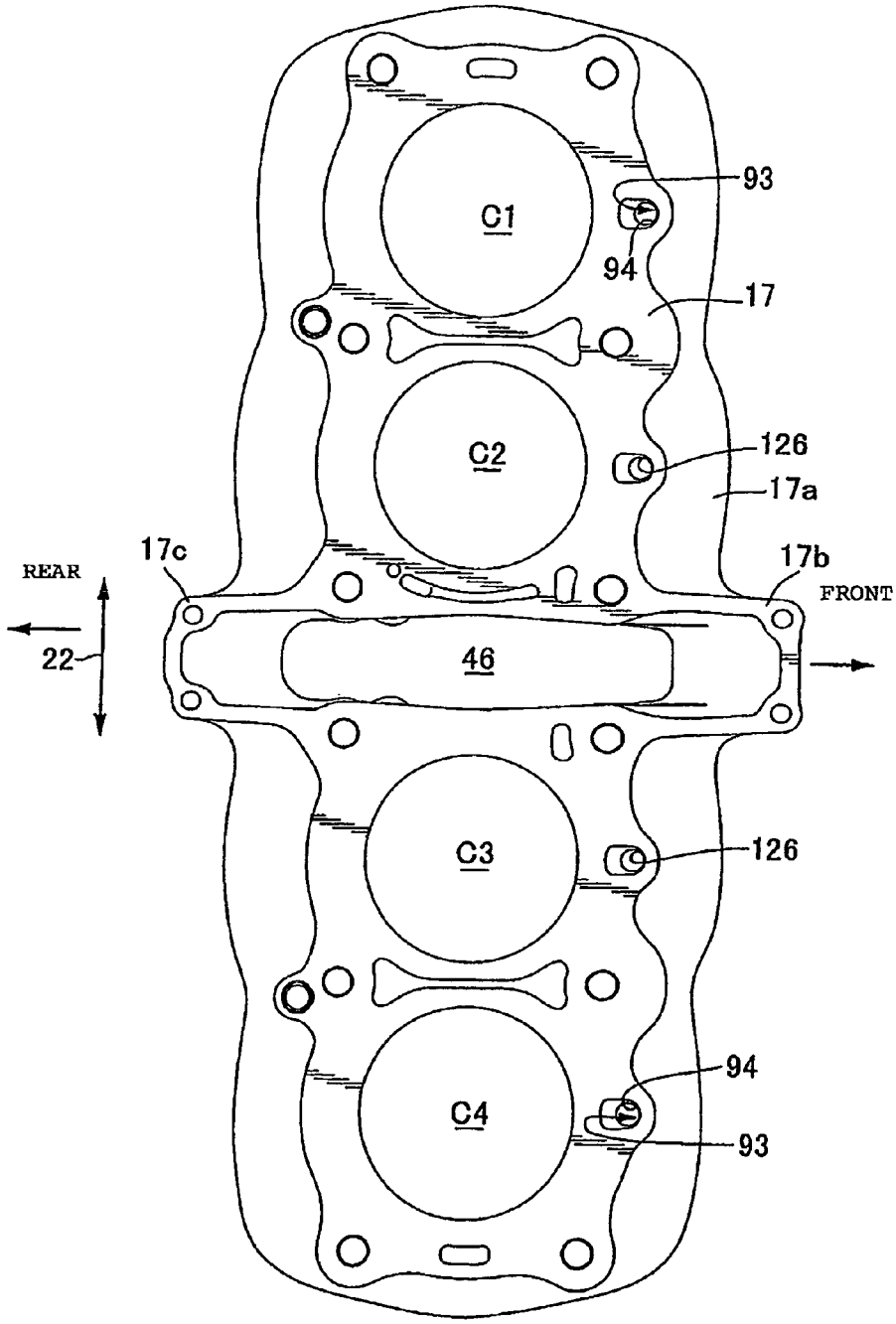
FIG. 5 is a view as viewed along arrows 5-5 of FIG. 3.
Figure 6:
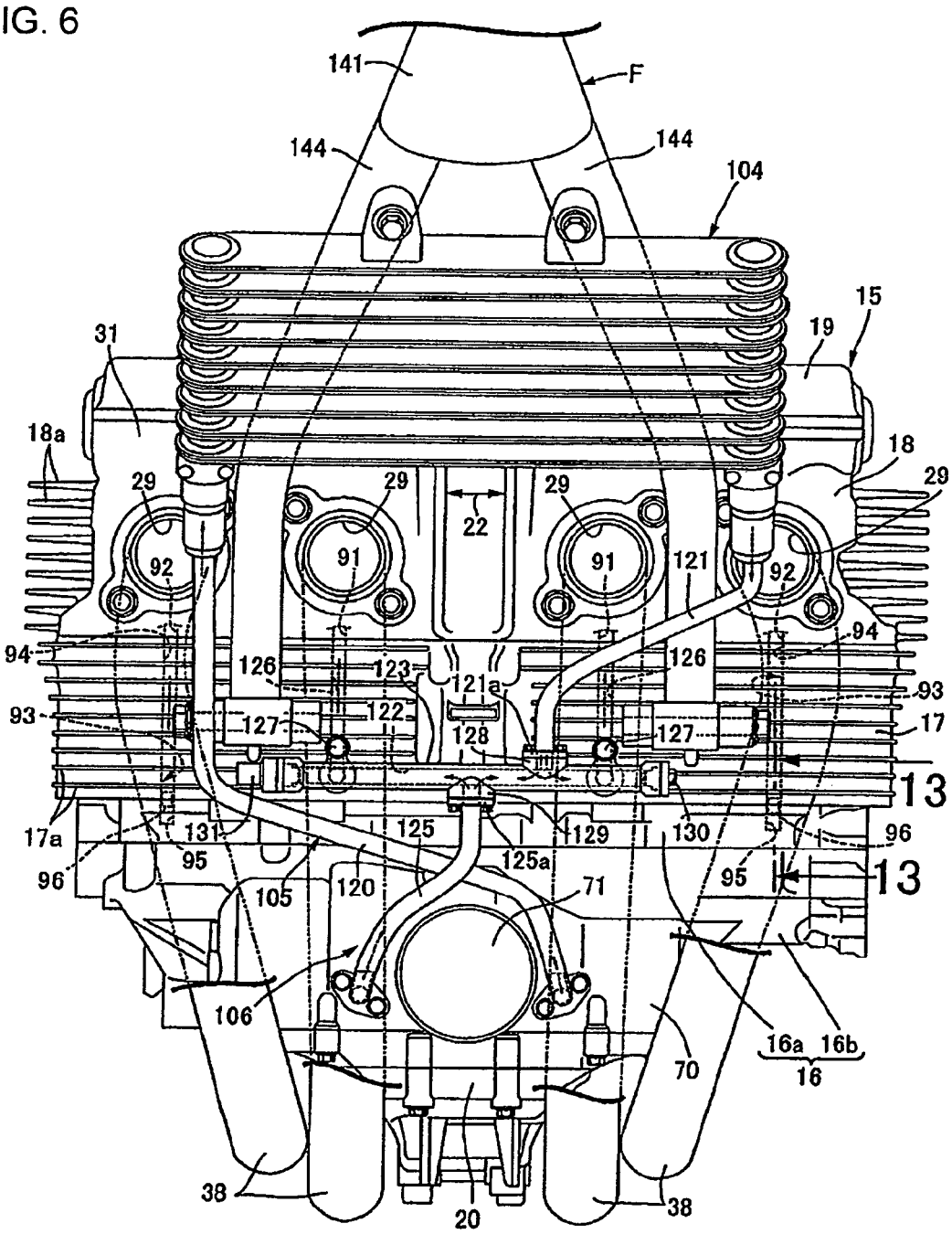
FIG. 6 is a front view of an engine body mounted on a body frame, as viewed from the direction of arrow 6 in FIG. 1.
Figure 7:
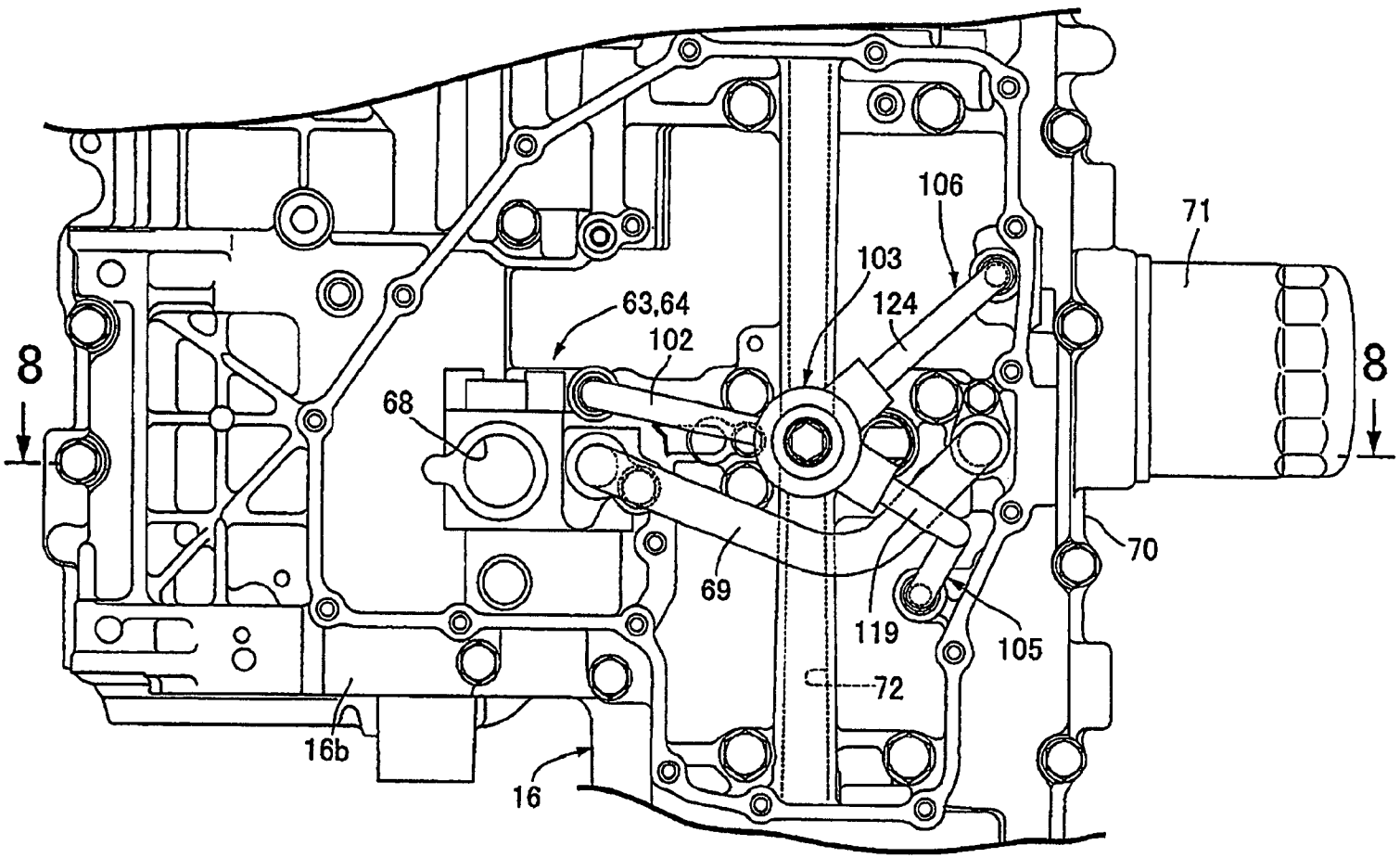
FIG. 7 is a view of a crankcase viewed from the direction of arrows 7-7, with an oil strainer removed, in FIG. 1.
Figure 8:
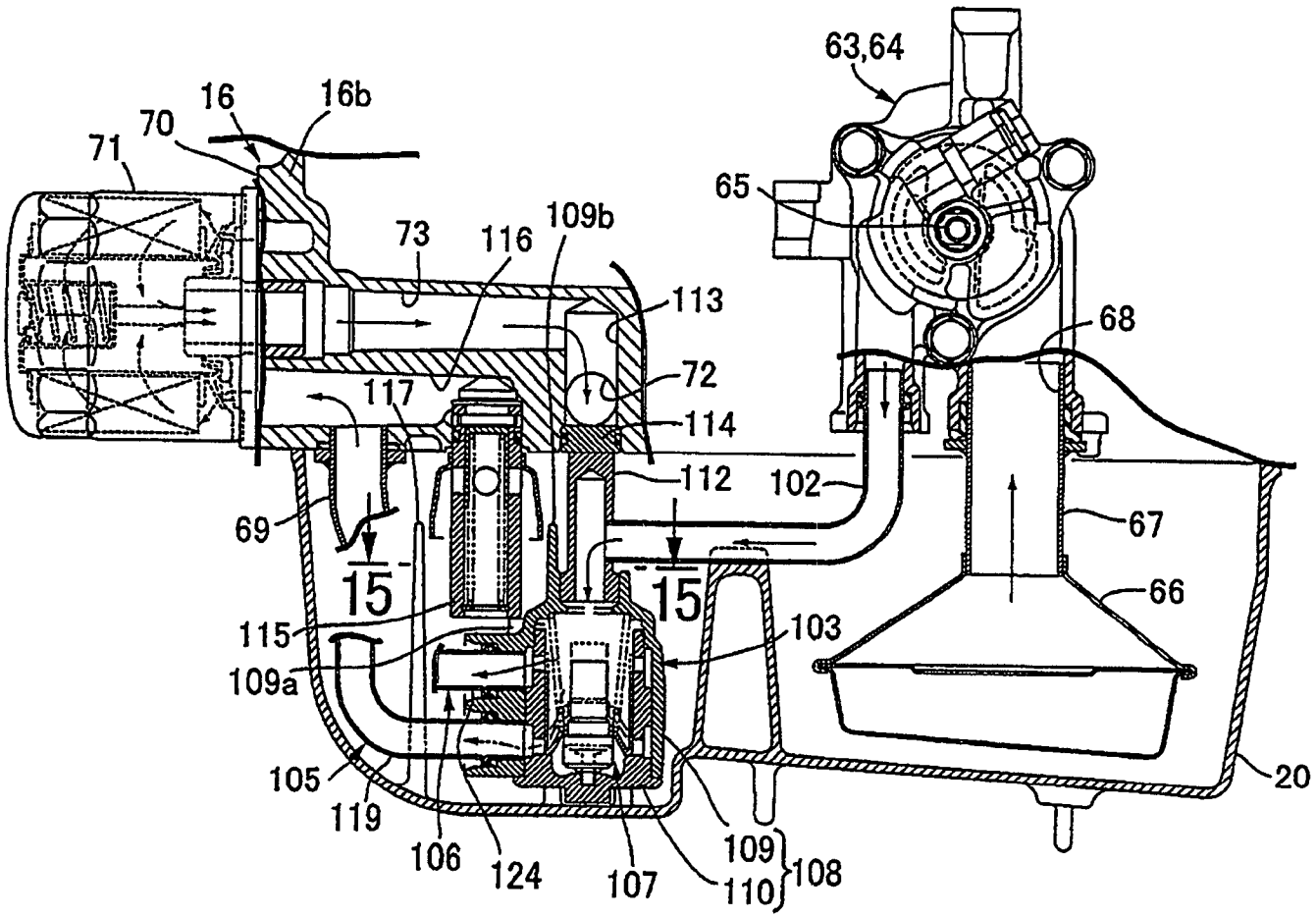
FIG. 8 is a cross-sectional view partially illustrating an oil passage structure in the crankcase and an oil pan, taken along line 8-8 in FIG. 7.

FIGS. 1 to 15 illustrate a first embodiment of the present invention. FIG. 1 is a right side lateral view of a motorcycle M. FIG. 2 is a longitudinal cross-sectional view of a four-cycle air-oil cooled engine, taken along line 2-2 of FIG. 3. FIG. 3 is a cross-sectional view taken along line 3-3 of FIG. 2. FIG. 4 is a view as viewed along arrows 4-4 in FIG. 3. FIG. 5 is a view as viewed along arrows 5-5 of FIG. 3. FIG. 6 is a front view of an engine body mounted on a body frame, viewed from the direction of arrow 6 in FIG. 1. FIG. 7 illustrates a crankcase viewed from the direction of arrows 7-7 in FIG. 3 with an oil strainer removed. FIG. 8 is a cross-sectional view partially illustrating an oil passage structure in the crankcase and in an oil pan, taken along line 8-8 in FIG. 7.

Figure 9:
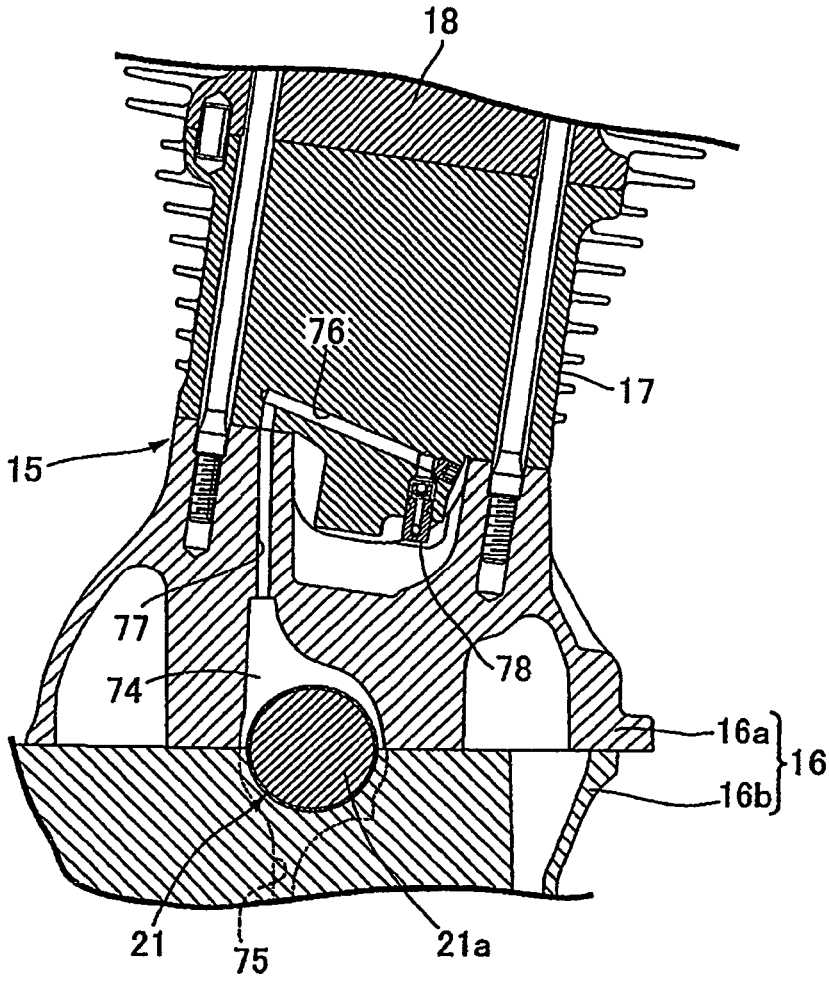
FIG. 9 is an enlarged cross-sectional view taken along line 9-9 of FIG. 2.
Figure 10:
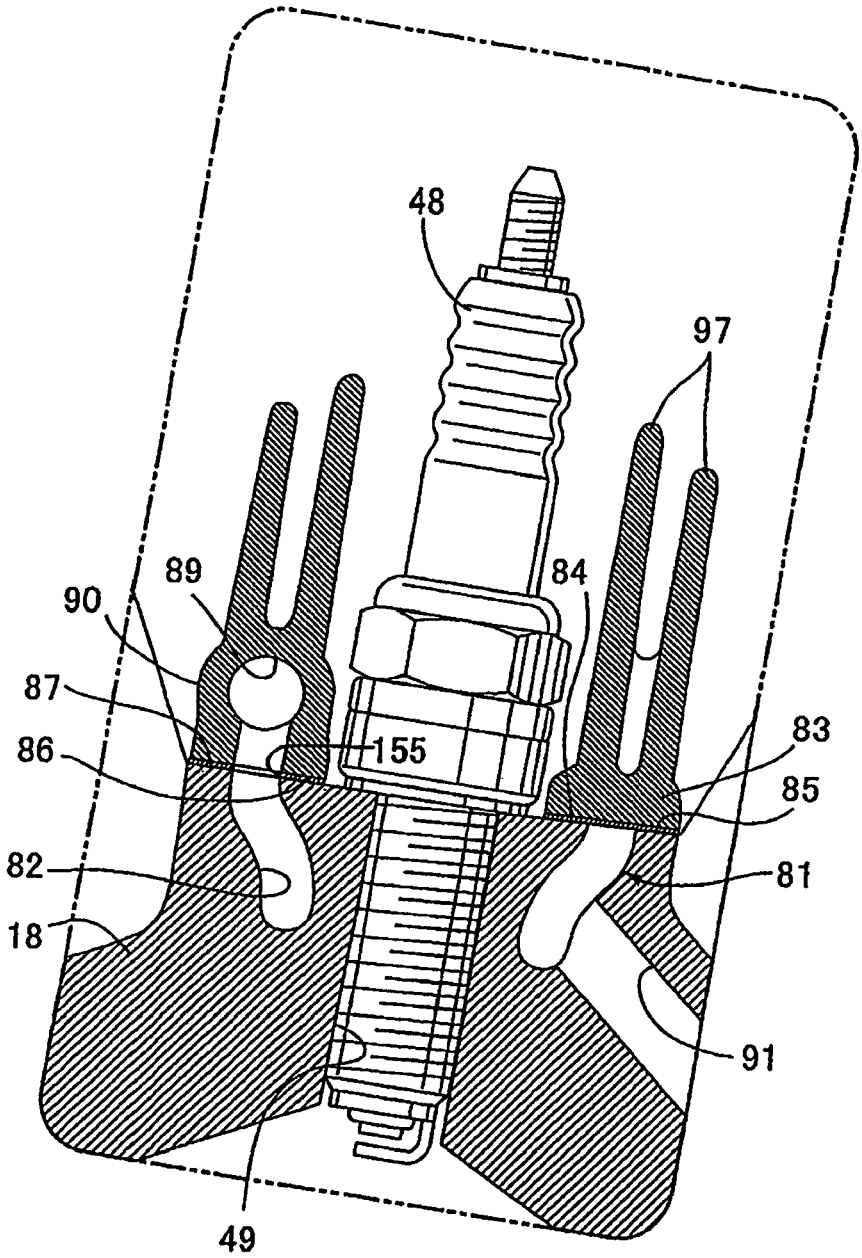
FIG. 10 is an enlarged view of a portion indicated with arrow 10 in FIG. 3.
Figure 11:
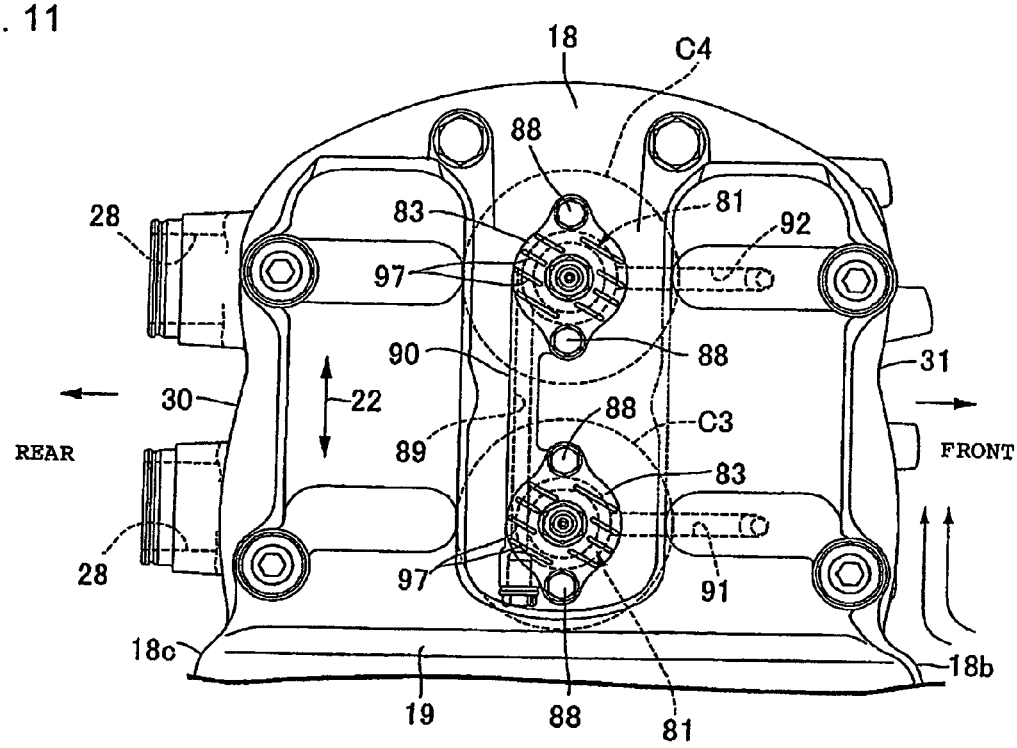
FIG. 11 is a view as viewed from a direction of arrow 11 in FIG. 3.
Figure 12:
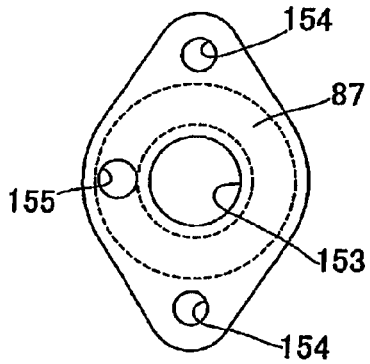
FIG. 12 is a plan view of a gasket.
Figure 13:
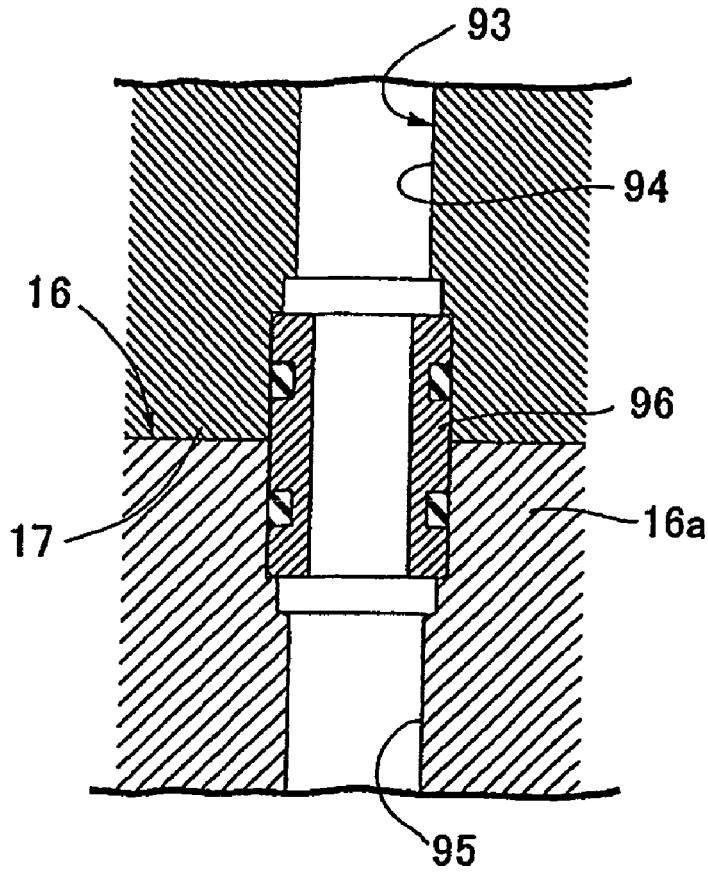
FIG. 13 is an enlarged cross-sectional view taken along line 13-13 in FIG. 6.
Figure 14:
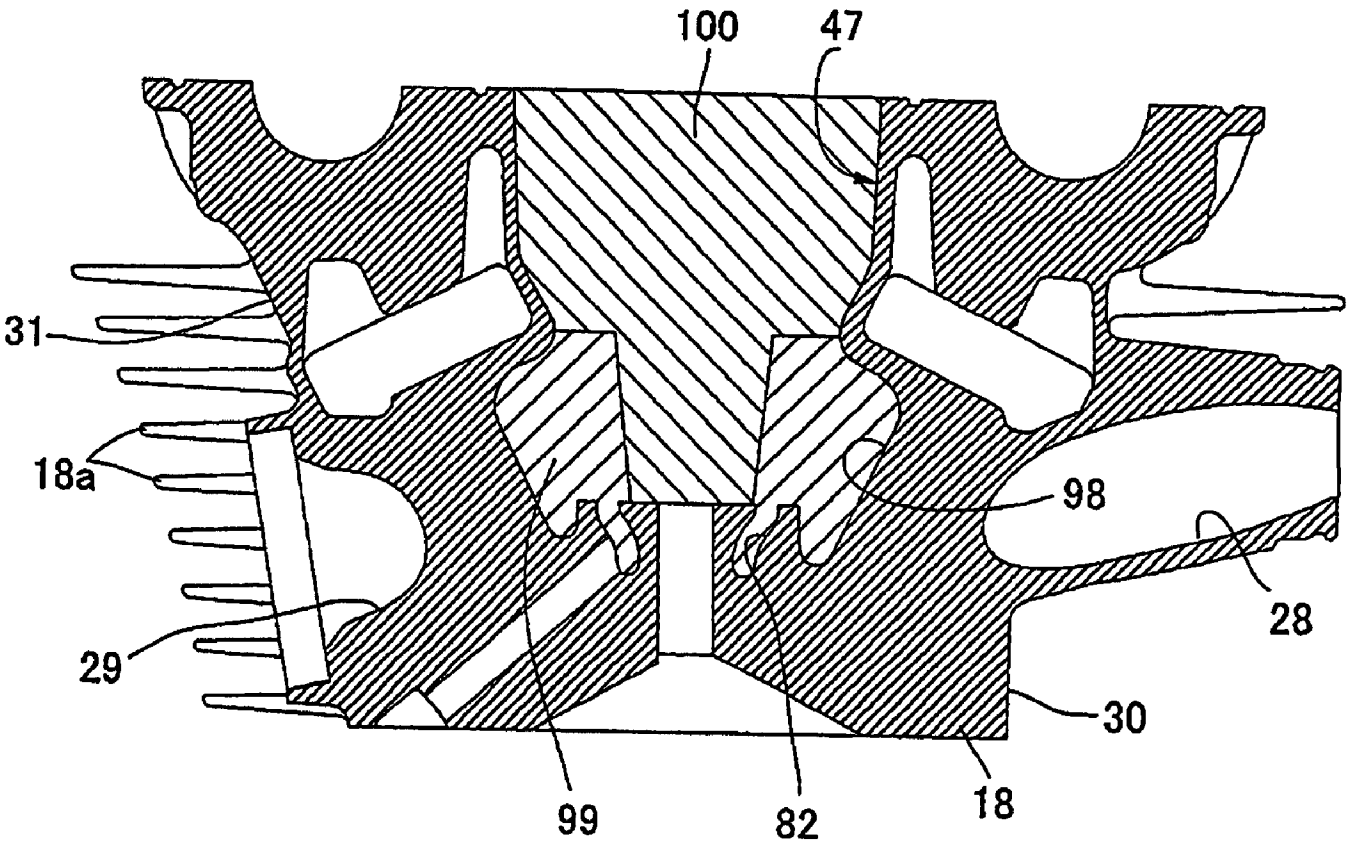
FIG. 14 is a cross-sectional view illustrating part of a cylinder head during casting.
Figure 15:
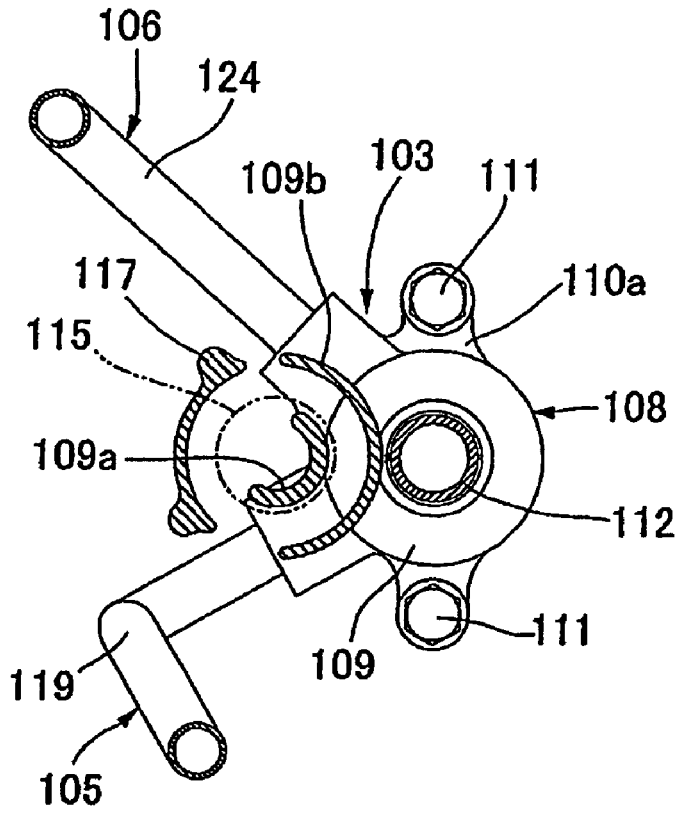
FIG. 15 is a cross-sectional view taken along line 15-15 in FIG. 8.

FIG. 9 is an enlarged cross-sectional view taken along line 9-9 of FIG. 2. FIG. 10 is an enlarged view of a portion indicated with arrow 10 in FIG. 3. FIG. 11 is a view as viewed from arrow 11 in FIG. 3. FIG. 12 is a plan view of a gasket. FIG. 13 is an enlarged cross-sectional view taken along line 13-13 in FIG. 6. FIG. 14 is a cross-sectional view illustrating part of a cylinder head during casting. FIG. 15 is a cross-sectional view taken along line 15-15 in FIG. 8.

As shown in FIG. 1, the motorcycle M includes a body frame F having a head pipe 141, a main frame 142, a pair of right and left center tubes 143, a pair of right and left down tubes 144, a pair of right and left pivot plates 145 and a pair of right and left seat rails 146.

The head pipe 141 steerably supports a front fork 140 rotatably supporting a front wheel WF at its lower end. The main frame 142 extends rearward from the head pipe 141. The center tubes 143 extend downward from the rear end of the main frame 142. The down tubes 144 slant rearward downwardly from the head pipe 141 at a steeper angle than the main frame 142. The pivot plates 145 are each provided at a corresponding one of the lower end portions of the center tubes 143. The seat rails 146 extend rearward from the respective pivot plates 145.

A steering handlebar 147 is connected to the upper end of the front fork 140. A riding seat 148 is mounted on the seat rails 146. A fuel tank 149 is located forward of the riding seat 148 so as to mount on and straddle the main frame 142.

An engine body 15 of a four-cycle in-line multi-cylinder air-oil cooled engine is disposed is space surrounded by the main frame 142, the center tubes 143 and the down tubes 144 in such a manner as to be supported by the down tubes 144 and the pivot plates 145.

Swing arms 150 are swingably supported at front end portions thereof by the respective pivot plates 145 via respective support shafts 151. The rear end portions of the swing arms 150 rotatably support a rear wheel WR driven by the engine. Rear shock absorbers (cushion units) 152 are each provided between the seat rail 146 and the swing arm 150.

As shown in FIGS. 2 and 3, the engine body 15 includes a crankcase 16, a cylinder block 17, a cylinder head 18 and a head cover 19. A plurality of cooling fins 17*a*, 17*a* are integrally provided on the external wall surface of the cylinder block 17 so as to project therefrom. A plurality of cooling fins 18*a*, 18*a* are integrally provided on the external wall surface of the cylinder head 18 so as to project therefrom. An oil pan 20 is joined to the bottom of the engine body 15, i.e., to the bottom of the crankcase 16. The crankcase 16 is formed by joining together an upper case half body 16*a* and a lower case half body 16*b*. A crankshaft 21 is rotatably journaled between the upper and lower case half bodies 16*a*, 16*b*.

Further, as shown in FIGS. 4 and 5, the engine body 15 includes a plurality of, four or more, cylinders, e.g., first, second, third and fourth cylinders C1, C2, C3 and C4, aligned in line with a cylinder arrangement direction 22 parallel to the axis of the crankshaft 21. Pistons 23 are each inserted into a corresponding one of the cylinders C1, C2, C3 and C4 so as to be slidable along the cylinder block 17. The pistons 23 are each connected to the crankshaft 21. Combustion chambers 24 are each defined between the cylinder block 17 and the cylinder head 18 for each cylinder C1 to C4 facing a corresponding one of the tops of the pistons 23.

Referring to FIG. 6, the pair of right and left down tubes 144 extend rearwardly and downwardly from the head pipe 141 at the front end of the body frame F. The engine body 15 is supported at its front surface lower portion by the lower end portions of the down tubes 144 in such that a cylinder axis C is inclined forwardly. In addition, the engine body 15 is mounted on the body frame F at a position located rearward of the down tubes 144.

On the cylinder head 18, bifurcate intake ports 28 are provided or bored for each cylinder C1 to C4 in a first sidewall 30 (a rear sidewall in the state of being mounted on the motorcycle) of the cylinder head 18. In addition, bifurcate exhaust ports 29 are provided or bored for each cylinder C1 to C4 in a second sidewall 31 (the front sidewall in the state of being mounted on the motorcycle) of the cylinder head 18 on the side opposite the first sidewall 30.

Opening ends or lips of the intake ports 28 communicating with respective combustion chambers 24 are provided in the cylinder head 18, and are opened and closed by the respective intake valves 32 spring-biased in a valve-closing direction. Opening ends or lips of the exhaust ports 29 communicating with respective combustion chambers 24 are provided in the cylinder head 18, and are opened and closed by respective exhaust valves 33 (see FIG. 4) spring-biased in a valve-closing direction.

Throttle bodies 35 each having a throttle valve 34 are connected to the respective intake ports 28 via respective insulators 36. Fuel injection valves 37 for injecting fuel toward the corresponding intake ports 28 are attached to the respective throttle bodies 35. As illustrated in FIG. 6, exhaust pipes 38 are individually connected to the respective exhaust ports 29. The exhaust pipes 38 bend downward from the second sidewall 31 from the cylinder head 18, passing below the engine body 15, and extend rearwardly.

An intake side valve train 39I for drivingly opening and closing the intake valves 32 is housed between the cylinder head 18 and the head cover 19. The intake side valve train 39I includes bottomed cylindrical lifters 40 and an intake side camshaft 42I. The lifters 40 are brought into abutment against respective stem ends at upper ends of the intake valves 32 of the cylinders C1 to C4 and slidably fitted into the cylinder head 18.

The intake side camshaft 42I is shared by the cylinders C1 to C4, extend parallel to the crankshaft 21, and rotatably journaled between the cylinder head 18 and a plurality of cam holders 41I fastened to the cylinder head 18. The valve train 39I operatively opens and closes the intake valves 32 by the lifters 40 sliding upward and downward in response to the rotation of the intake side camshaft 42I.

An exhaust side valve train 39E for drivingly opening and closing the exhaust valves 33 includes an exhaust side camshaft 42E shared by the cylinders C1 to C4, extending parallel to the crankshaft 21 and rotatably journaled between the cylinder head 18 and a plurality of cam holders 41E fastened to the cylinder head 18. The exhaust side valve train 39E is configured similar to the intake side valve train 39I and housed between the cylinder head 18 and the head cover 19.

A timing transmission mechanism 44 (see FIG. 2) is provided between the intake side camshaft 42I and exhaust side camshaft 42E, and the crankshaft 21. The timing transmission mechanism 44 transmits the rotation power of the crankshaft 21 to the intake side camshaft 42I and the exhaust side camshaft 42E at a reduction ratio of 1/2. A cam chain passage 46 is used for running a cam chain 45 of the timing transmission mechanism 44. The cam chain passage 46 is provided at a central portion extending along the cylinder arrangement direction 22 of the first to fourth cylinders C1 to C4, i.e., at a corresponding portion between the second and third cylinders C2 and C3 so as to extend over the crankcase 16, the cylinder block 17 and the cylinder head 18.

In addition, the cam chain passage 46 is formed to project forwardly of the front surface of the cylinder block 17 and the cylinder head 18, and also to project rearwardly of the rear surface of the cylinder block 17 and the cylinder head 18. Front projecting portions 17*b*, 18*b* are integrally formed at a central portion of the front surface of the cylinder block 17 and the cylinder head 18, and are extended along the cylindrical arrangement direction 22 so as to project forwardly, thereby forming part of the cam chain passage 46.

Rear projecting portions 17*c*, 18*c* are integrally provided at a central portion of the rear surface of the cylinder block 17 and the cylinder head 18, and are extended along the cylinder arrangement direction 22 so as to project rearward, forming part of the cam chain passage 46.

A pair of plug attachment concave portions 47 are formed on the cylinder head 18 to open left-laterally and upward, and the right-laterally and upward, respectively, in the state where the engine body 15 is mounted on the motorcycle. The pair of plug attachment concave portions 47 are disposed at respective portions corresponding to the first and second cylinders C1, C2, and to the third and fourth cylinders C3, C4 so as to put the cam chain passage 46 therebetween.

Spark plugs 48 are attached to the cylinder head 18 in such a manner that their tips face the central portions of the combustion chambers 24 of the first through fourth cylinders C1 to C4. Spark plug mounting holes 49 used to attach the spark plugs 48 thereto are each provided at a central portion of each of the cylinders C1 to C4 and on each of the bottoms of the plug attachment concave portions 47.

As shown in FIG. 2, a generator 50 is coupled to one end of the crankshaft 21. The generator 50 is housed in a generator chamber 52 defined between the crankcase 16 and a side cover 51 joined to the crankcase 16. The rotary power of the crankshaft 21 is transmitted via an endless chain 53 to the rear wheel of the motorcycle. The rotary power of the crankshaft 21 is transmitted to the chain 53 via a first reduction gear set 54, a dumper spring 55, a starting clutch 56 and a gear transmission 57.

The gear transmission 57 includes a main shaft 58, a counter shaft 59, a plurality of speed-change stage gears, e.g., first through fifth speed gears G1, G2, G3, G4, G5, and a shift drum 60. The main shaft 58 is adapted to receive the rotary power of the crankshaft 21 transmitted thereto via the damper spring 55 and the starting clutch 55. The counter shaft 59 has an axis parallel to the main shaft 58 and a portion projecting from the crankcase 16 to fixedly support a drive sprocket 61 around which the chain 53 is wound. The first through fifth speed gears G1 to G5 are provided between the main shaft 58 and the counter shaft 59 so as to enable selective establishment.

The shift drum 60 can be turned around an axis parallel to the main shaft 58 and to the counter shaft 59 so as to selectively establish the first through fifth speed gears G1 to G5 in response to the turning operation thereof. The gear transmission 57 is housed in the crankcase 16. In addition, the main shaft 58 and the counter shaft 59 are rotatably journaled between upper and lower case half bodies 16*a*, 16*b* of the crankcase 16.

With reference to FIGS. 7 and 8, a cooling oil pump 63 and a lubricating oil pump 64 are unitized in such a manner as to have a common pump shaft 65 and arranged on the bottom of the crankcase 16. An oil strainer 66 is housed in the oil pan 20 joined to the bottom of the crankcase 16. An oil suction pipe 67 extends upward from the oil strainer 66. The upper portion of the oil suction pipe 67 is fixedly fitted (from below) to a suction passage 68 shared by the cooling oil pump 63 and the lubricating oil pump 64. Thus, the cooling oil pump 63 and the lubricating oil pump 64 pumps oil from the oil pan 20 via the oil strainer 66. Power is transmitted from the crankshaft 21 to the pump shaft 65.

A lubricating discharge pipe 69 communicating with the lubricating oil pump 64 extends forward (rightward in FIG. 7 and leftward in FIG. 8) while bending in the oil pan 20. The lubricating discharge pipe 69 is connected with an oil filter 71 attached to a front lateral wall 70 of the crankcase 16. The front wall 70 faces the front of the motorcycle in the state where the engine body 15 is mounted on the motorcycle. The lower case half body 16*b* of the crankcase 16 is provided with a main gallery 72. The main gallery 72 communicates with an oil filter outlet passage 73 extending from the central portion of the oil filter 71.

With reference to FIG. 9, journal portions 21*a* are provided on the crankshaft 21 and among the adjacent cylinders C1 to C4 so as to rotatably journal the crankshaft 21 between the upper and lower half bodies 16*a*, 16*b* of the crankcase 16. Annular lubricating chambers 74 are defined between the journal portions 21*a* and the upper and lower case half bodies 16*a*, 16*b* of the crankcase 16. The lower case half body 16*b* is provided with oil passages 75 branching from the main gallery 72 and extending toward a plurality of the lubricating chambers 74.

The cylinder block 17 is provided with an oil jet-purposed oil passage 76 between the first and second cylinders C1, C2, and between the third and fourth cylinders C3, C4. Oil is led from the lubricating chambers 74 to the oil jet-purposed oil passages 76 via oil passages 77 provided in the upper case half body 16*a*. Generally, T-shaped distribution pipes 78 are connected to the oil jet-purposed oil passages 76.

Spray nozzles 79, 79 are attached to the distribution pipe 78 connected to the oil jet-purposed oil passage 76 between the first and second cylinders C1, C2 in order to spray oil toward the respective pistons 23 of the first and second cylinders C1, C2. The Spray nozzles 79, 79 are attached to the distribution pipe 78 connected to the oil jet-purposed oil passage 76 between the third and fourth cylinders C3, C4 in order to spray oil toward the respective pistons 23 of the cylinders C3, C4.

Oil from the main gallery 72 is supplied for lubrication to the intake side valve train 39I and the exhaust side valve trains 39E via oil passages (not shown) provided in the cylinder block 17 and the cylinder head 18.

As shown in FIG. 10, oil jackets 81 adapted to circulate oil supplied under pressure from the cooling oil pump 63 are formed in the cylinders C1 to C4 so as to surround the spark plug mounting holes 49. The oil jacket 81 is formed such that an opening end of a ring-like groove 82, provided in the cylinder head 18 so as to surround the spark plug mounting hole 49, is closed by a cover member 83. The cover member 83 is formed like a ring surrounding the spark plug 48. The cover member 83 is secured to the cylinder head 18.

The cylinder head 18 is formed with a respective set of first and second sealing surfaces 84, 85 for each of the cylinders C1 to C4. The first and second sealing surfaces 84, 85 are disposed on the same plane, which is perpendicular to the axis of the spark plug mounting hole 49. The first and second sealing surfaces 84, 85 are situated with the opening end of the groove 82 therebetween.

The cover member 83 has a flat lower surface 86 opposite the first and second sealing surfaces 84, 85. The cover member 83 is fastened to the cylinder head 18 by special fastening members, e.g., a pair of bolts 88, 88 as illustrated in FIG. 11, while interposing a gasket 87 between the first and second sealing surfaces 84, 85 and the flat surface 86 of the cover member 83.

Referring to FIG. 12, the gasket 87 has a hole 153 formed therein at a central portion thereof. The hole 153 is adapted to receive the spark plug 48. The gasket 87 has an outer shape generally conforming to the cover member 83. Further, the gasket 87 has a pair of insertion holes 154, 154 formed therein such that the hole 153 is located therebetween. The insertion holes 154, 154 receive the bolts 88, 88 for fastening the cover member 83 to the cylinder head 18.

The oil jackets 81 of the pair of adjacent cylinders C1, C2 are configured such they communicate with each other via a communicating passage 89 extending in the cylinder arrangement direction 22. The pair of cover members 83, 83 arranged for the pair of respective adjacent cylinders C1, C2 is integrally joined to both ends of a cylindrical connecting portion 90. The cylindrical connecting portion 90 is formed with the communicating passage 89 communicating with the oil jackets 81 of the cylinders C1, C2 via a communicating hole 155 (see FIG. 12) formed in the gasket 87.

Similarly, the oil jackets 81 of the pair of adjacent cylinders C3, C4 are configured to communicate with each other via a communicating passage 89 extending in the cylinder arrangement direction 22. The pair of cover members 83, 83 arranged for the pair of respective adjacent cylinders C3, C4 are integrally joined to both ends of a cylindrical connecting portion 90. The cylindrical connecting portion 90 is formed with the communicating passage 89 communicating with the oil jackets 81 of the cylinders C3, C4 via a communicating hole 155 (see FIG. 12) formed in the gasket 87.

Thus, in the illustrative embodiment, the cover members 83 of the first and second cylinders C1, C2 are integrally installed via the cylindrical connecting portion 90. Also, the cover members 83 of the third and fourth cylinders C3, C4 are integrally installed via a corresponding cylindrical connecting portion 90.

The spark plug mounting holes 49 are provided in the cylinder head 18 having the first sidewall 30 (the rear sidewall in the state of being mounted on the motorcycle) bored with the intake port 28 and the second sidewall 31 (the front sidewall in the state of being mounted on the motorcycle) bored with the exhaust port 29 so as to be disposed between the first and second sidewalls 30, 31. However, the connecting cylindrical portions 90 are disposed at a position offset from the center of the cover members 83 toward the first sidewall 30, i.e., toward the side opposite the exhaust port 29.

The cylinder head 18 is provided with a lead-in side oil passage 91 and a lead-out side oil passage 92. The lead-in side oil passage 91 is adapted to lead oil from the side of the exhaust port 29 to the oil jacket 81 of one of the pair of adjacent cylinders. The lead-out side oil passage 92 is adapted to lead oil toward the side of the exhaust port 29 from the oil jacket 81 of the other of the pair of adjacent cylinders.

In the illustrative embodiment, a pair of lead-in side oil passages 91 adapted to lead in oil from the side of the exhaust port 29 are provided in the oil jacket 81 of one cylinder C2 of the first and second adjacent cylinders C1, C2, and in the oil jacket 81 of one cylinder C3 of the third and fourth adjacent cylinders C3, C4. In addition, a pair of lead-out side oil passages 92 adapted to lead oil toward the side of the exhaust port 29 from the oil jacket 81 of the other cylinder C1 of the first and second cylinders C1, C2 and from the oil jacket 81 of the other cylinder C4 of the third and fourth adjacent cylinders C3, C4.

The lead-in side oil passages 91 are provided in the cylinder head 18 at respective portions corresponding to the second and third cylinders C2, C3, internally disposed in the cylinder arrangement direction 22, among the first and second cylinders C1, C2 and the third and fourth cylinders C3, C4. The lead-out side oil passages 92 are provided in the cylinder head 18 at respective portions corresponding to the first and fourth cylinders C1, C4, externally disposed in the cylinder arrangement direction 22, among the first and second cylinders C1, C2 and the third and fourth cylinders C3, C4.

A pair of oil discharge passages 93, 93 adapted to lead oil from the pair of lead-out side oil passages 92 into the crankcase 16 are provided in the cylinder block 17 and the upper case half body 16*a* of the crankcase 16 so as to individually communicate with the respective lead-out side oil passages 92. The oil discharge passages 93 are each composed of a passage hole 94 provided in the cylinder block 17, and a passage hole 95 provided in the upper case half body 16*a* of the crankcase 16. The passage hole 94 is coaxially continuous with the passage hole 95. As shown in FIG. 13, cylindrical tubular members 96 are each fitted at both ends to the opposite ends of the passage holes 94, 95 in a liquid-tight manner.

As illustrated in FIG. 11, a plurality of cooling fins 97 having at least portion thereof is disposed at a portion overlapping the communicating passage 89, as viewed from above, are integrally formed on the cover member 83. The cooling fins 97 are each respectively disposed at an incline with respect to the front-rear direction of the motorcycle in such a manner as to take an outer position as it goes toward the rearward of the motorcycle, in the state where the engine body 15 is mounted on the motorcycle such that the cylinder arrangement direction 22 is oriented a right-left direction.

With reference to FIG. 14, an annular recessed portion 98 is formed on the inner circumference close to the bottom of the plug attachment concave portion 47 provided in the upper portion of the cylinder head 18. Further, in order to facilitate the fastening of the cover member 83, the annular recessed portion 98 is formed to bring the vertical intermediate portion of the plug attachment concave portion 47 into an overhanging state.

During casting of the cylinder head 18, the plug attachment concave portions 47 and the grooves 82 forming the oil jackets 81 are formed by a plurality of cores 99 circumferentially divided to form the annular concave portions 98 and the grooves 82, and by a mold 100 allowed to be partially fitted to the cores.

As shown in FIG. 8, a cooling oil discharge pipe 102, which communicates with the discharge port of the cooling oil pump 63, is provided with a branch portion 103. The branch portion 103 is housed in the oil pan 20. An oil cooling circuit 105 having an oil cooler 104 (see FIG. 6) and a bypass circuit 106 for bypassing the oil cooling circuit 105 are each connected to the branch portion 103. A thermostat 107 is disposed in the branch portion 103 in order to control the flow of oil discharged from the cooling oil pump 63 to the oil cooling circuit 105 and the bypass circuit 106. In addition, the branch portion 103 includes a thermostat housing case 108 installed continuously with the cooling oil discharge pipe 102 in such a manner as to fixedly house the thermostat 107 therein.

The thermostat housing case 108 includes a bottomed cylindrical upper case 109 having an opening lower portion and a bottomed cylindrical lower case 110 having an opening upper portion and fitted to the upper case 109 from below. The lower portion of the thermostat housing case 108 is attached to the oil pan 20. As illustrated in FIG. 15, the lower case 110 is provided with a flange 110*a* at a lower end portion. The flange 110*a* is fastened to the oil pan 20 using fasteners, e.g., a pair of bolts 111, 111.

A bottomed cylindrical connection pipe 112 extends in a direction of mounting and dismounting the oil pan 20 to and from the crankcase 16, i.e., in the vertical direction, and is connected with the cooling oil discharge pipe 102. The connection pipe 112 is fitted at a lower portion thereof with the upper portion of the thermostat housing case 108 in a liquid-tight manner.

An upper end block portion of the connection pipe 112 is abutted against a plug member 114 which is secured to the crankcase 16 so as to block the lower end portion of a communication hole 113. The communication hole 113 is provided in the crankcase 16 so as to allow the oil filter outlet passage 73, extending from the central portion of the oil filter 71, to communicate with the main gallery 72.

A relief valve 115 is connected to the discharge port of the lubricating oil pump 64. In the illustrative embodiment, the upper portion of the relief valve 115 is fitted to the crankcase 16 from below in a liquid-tight manner in such a way as to be connected to an inlet side passage 116. The inlet side passage 116 is provided in the crankcase 16 in such that the lubricating discharge pipe 69 communicating with the lubricating oil pump 64 is allowed to be connected to the oil filter 71.

Further, an arcuate support projection 109*a* is provided to project from the upper case 109 of the thermostat housing case 108 attached to the oil pan 20 joined to the bottom of the crankcase 16. The support arcuate projection 109*a* is abutted against the lower end of the relief valve 115 so as to support the relief valve 115.

A splash suppression wall 109*b* adapted to suppress the splash of oil discharged from the relief valve 115 is integrally provided on the upper case 109 of the thermostat housing case 108 so as to surround at least a portion of the outer circumference of the relief valve 115, i.e., a generally semicircle thereof in the illustrative embodiment. A circular wall 117 is integrally provided on the oil pan 20 so as to surround a portion of the outer circumference of the relief valve 115 from the side opposite the splash suppression wall 109*b*.

The oil cooling circuit 105 includes a first oil pipe 119, a second oil pipe 120 and a third oil pipe 121. The first oil pipe 119 has one end connected to the thermostat housing case 108 and the other end connected to and supported by the front wall inner surface of the crankcase 16. The second oil pipe 120 has one end connected to the front wall inner surface of the crankcase 16 continuously with the other end of the first oil pipe 119 and the other end connected to the oil cooler 104 as illustrated in FIG. 6. The third oil pipe 121 is adapted to lead the oil cooled by the oil cooler 104 to the outside thereof. The oil cooler 104 is supported by the down tubes 27 of the body frame F so as to be located above the cylinder block 17 in the engine body 15 and in front of the engine body 15.

A passage-forming member 123 is attached to the front wall of the cylinder block 17 of the engine body 15 using bolts 127, 127 so as to be located below the oil cooler 104 and facing the front of the motorcycle. The passage-forming member 123 is formed separately from the engine body 15, and forms a branch passage 122 extending in the cylinder arrangement direction 22.

The bypass circuit 106 includes a fourth oil pipe 124, a fifth oil pipe 125, the branch passage 122 and a pair of oil supply passages 126, 126. The fourth oil pipe 124 has one end connected to the thermostat housing case 108, and the other end connected to and supported by the front wall inner surface of the crankcase 16. The fifth oil pipe 125 is connected at one end to the front wall external surface of the crankcase 16 at a position putting the oil filter 71 between the fifth oil pipe 125 and a connecting point of the second oil pipe 120 to the crankcase 16, so as to be communicated with the fourth oil pipe 124.

The branch passage 122 communicates with the other end of the fifth oil pipe 125. The oil supply passages 126, 126 are each provided in the cylinder block 17 to have one end communicating with the branch passage 122 and the other end communicating with a corresponding one of the pair of lead-in side oil passages 91.

A pair of the oil supply passages 126, 126 are provided in the cylinder block 17 at respective portions corresponding to two cylinders adjacent to each other closely to the center along cylinder arrangement direction 22, i.e., corresponding to the second and third cylinders C2, C3, so as to be communicated with the respective lead-in side oil passages 91 provided in the cylinder head 18. Both the ends of the passage forming members 123 are attached to the cylinder block 17 in such that both the ends of the branch passage 122 communicate with both the respective oil supply passages 126.

Connection pipe portions 123*a* (see FIG. 3) communicating with both the ends of the branch passage 122 is integrally provided to project therefrom in such a way as to be fitted to the cylinder block 17 in a liquid-tight manner. The connection pipe portions 123*a* communicate with the respective oil passages 126 of the cylinder block 17.

An attachment flange 121*a* is provided at the lower end of the third oil pipe 121 of the oil cooling circuit 105. The third oil pump 121 extends downward from the oil cooler 104. The attachment flange 121*a* is fastened to a flange 128 provided at an upper portion of the longitudinally intermediate portion of the passage-forming member 123. In this way, the oil cooler 104 adapted to cool portion of the oil discharged from the cooling oil pump 63 and the oil cooling circuit 105 adapted to lead the oil cooled by the oil cooler 104 to the branch passage 122 are provided between the cooling oil pump 63 and the branch passage 122.

On the other hand, an attachment flange 125*a* is provided at the upper end of the fifth oil pipe 125 of the bypass circuit 106 and extending upward from the crankcase 16. The attachment flange 125*a* is fastened to a flange 129 provided at a lower portion of the longitudinally intermediate portion of the passage-forming member 123. Accordingly, the fifth oil pipe 125 of the bypass circuit 106 is connected to the passage-forming member 123 from below so as to be continuous with the branch passage 122. Also, the third oil pipe 121 of the oil cooling circuit 105 which leads oil from the oil cooler 104 is connected to the passage-forming member 123 from above so as to be continuous with the branch circuit 122.

As shown in FIG. 6, the passage-forming member 123 is formed cylindrical to be closed at one end by the plug member 130. Also, the oil temperature sensor 131 used to detect temperature of the oil flowing in the branch passage 122 is attached to the passage-forming member 123 so as to close the other end thereof.

A description of operation of the first embodiment of the present invention is provided below.

The cylinder head 18 is provided with the pair of lead-in side oil passages 91 and the pair of lead-out side oil passages 92. The lead-in side oil passages 91 are adapted to lead oil from the side of the exhaust ports 29 to the respective oil jackets 81 of the second and third cylinders C2, C3 of the first through fourth cylinders C1 to C4 aligned in the cylinder arrangement direction 22. The lead-out side oil passages 92 are adapted to lead oil toward the exhaust ports 29 from the respective oil jackets 81 of the first and fourth cylinders C1, C4 of the first through fourth cylinders C1 to C4.

Further, the respective oil jackets 81 of the first and second cylinders C1, C2 adjacent to each other communicate with each other via the communicating passage 89 extending in the cylinder arrangement direction 22. Similarly, the respective oil jackets 81 of the third and fourth cylinders C3, C4 adjacent to each other communicate with each other via the communicating passage 89 extending in the cylinder arrangement direction 22. Accordingly, the oil jackets 81 adjacent to each other communicate with each other via the communicating passage 89.

Oil is led to one of the oil jackets 81 from the side of the exhaust ports 29 via the lead-in side oil passage 91. Oil from the other of the oil jackets 81 is led toward the exhaust ports 29 via the lead-out side oil passage 92. The oil flowing in the oil jackets 81 can cool the peripheries of the spark plug mounting holes 49 and the oil flowing through the lead-in side oil passage 91 and the lead-out side oil passage 92 can cool the cylinder head 18 on the peripheries of the exhaust ports 29.

Thus, the communicating passage 89 connecting both the jackets 81 are not required to be shaped complicated but may have a simple shape so as to extend in the cylinder arrangement direction 22. Such configuration of passages can achieve the cooling performance of the exhaust port 29 and the simplification of the oil passages.

The engine body 15 is mounted on the motorcycle in such a manner that the second sidewall 31 of the cylinder head 18, i.e., the sidewall bored with the exhaust port 29 is allowed to face the front. Thus, the peripheries of the lead-in side oil passages 91 and of the lead-out side oil passages 92 are cooled by running air during traveling operation of the motorcycle so as to cool oil flowing through the lead-in side oil passages 91 and the lead-out side oil passages 92, thereby effectively cooling the cylinder head 18.

Furthermore, in the cylinder head 18 of the engine body 15 where the first through fourth cylinders C1 to C4 are arranged in the cylinder arrangement direction 22, the peripheries of the two cylinders located inwardly in the cylinder arrangement direction 22, i.e., of the second and third cylinders C2, C3 are more liable to be raised to high temperature than the peripheries of the two cylinders located outwardly in the cylinder arrangement direction 22, i.e., of the first and fourth cylinders C1, C4.

However, the lead-in side oil passages 91 are provided in the cylinder head 18 at the respective portions corresponding to the second and third cylinders C2, C3. In addition, the lead-out side oil passages 92 are provided in the cylinder head 18 at the respective portions corresponding to the first and fourth cylinders C1, C4. Thus, oil having lower temperature, because of not yet led to the oil jackets 81, than oil flowing through the lead-out side oil passages 92 can effectively cool the peripheries of the exhaust ports 29 of the second and third cylinders C2, C3 in the cylinder head 18.

Additionally, in the illustrative embodiment, the cam chain passage 46 is provided at the central portion in the cylinder arrangement direction 22 so as to extend over the crankcase 16, the cylinder block 17 and the cylinder head 18. The front projecting portion 18*b* is provided integrally with the front surface of the cylinder head 18 so as to project forwardly and to form part of the cam chain passage 46.

As shown in FIG. 11, during operation of the motorcycle, running-air which comes in contact with the front surface of the cylinder head 18, collectively flows in the direction away (shown by arrows presented in the vicinity of the front projecting portion 18*b* of the cylinder head 18) from the cam chain passage 46, i.e., toward the outside in the cylinder arrangement direction 22 with the assistance of the front projecting portion 18*b*.

The front surface of the cylinder head 18 on the side where the lead-out side oil passages 92 through which the heated oil flows are arranged is exposed to a large amount of air. Thus, oil flowing through the lead-out side oil passages 92 can be effectively cooled. Further, the air-oil cooled engine of the illustrative embodiment is configured to have in-line four cylinders and the cam chain passage 46 is disposed at the central portion in the cylinder arrangement direction 22. However, the same effect can be provided for an in-line two-cylinder air-oil cooled engine where a cam chain passage is disposed on one end side in the cylinder arrangement direction 22.

The passage holes 94 and 95 axially communicating with each other are provided in the cylinder block 17 and the crankcase 16, respectively, so as to form the oil discharge passages 93 adapted to lead oil from the lead-out side oil passages 92 into the crankcase 16. In addition, the cylindrical tubular members 96 are each fitted at both ends to the opposite ends of the passage holes 94, 95. Thus, the cylinder block 17 and the crankcase 16 can be positioned by the cylindrical tubular members 96 by use of the passage holes 94 and 95 which are provided in the cylinder block 17 and the crankcase 16, respectively, so as to form the oil discharge passage 93. This can eliminate requirement of specially positioning hole thereby reducing machining man-hours.

The pair of oil discharge passages 93 individually communicating with the pair of respective lead-out side oil passages 92 are provided in the cylinder block 17 and the crankcase 16. Accordingly, oil from both the lead-out side oil passages 92 is discharged, without interflow, via the pair of independent oil discharge passages 93 into the crankcase 16. Thus, discharge side passage resistance can be suppressed to a low level compared with the interflow of the oil.

The cylinder head 18 is provided with the spark plug mounting holes 49 used to attach the spark plugs 48 therein and with the ring-like grooves 82 surrounding the corresponding spark plug mounting holes 49. The cover members 83 closing the lips of the grooves 82 are each secured to the cylinder head 18 so as to be formed like a ring surrounding the spark plug 48 in such a manner as to form the oil jacket 81 arranged around the spark plug mounting hole 49 between the cylinder head 18 and the cover member 83.

The cylinder head 18 is provided with the first and second flat sealing surfaces 84, 85 disposed along a plane perpendicular to the axis of the spark plug mounting hole 49 and disposed with the opening of the groove 82 therebetween. The cover members 83 each having the flat surface 86 opposed to the first and second sealing surfaces 84, 85 are each secured to the cylinder head 18 with the gasket 87 interposed between the first and second sealing surfaces 84, 85 and the flat surface 86 of the cover member 83.

In this way, the groove 82 between the cover members 83 and the cylinder head 18 can be sealed internally and externally of the groove 82 with the simple sealing structure using the single gasket 87. Thus, while simplifying the sealing structure and ensuring sealing performance, assembling performance can be enhanced.

Additionally, the cover members 83 are each fastened to the cylinder head 18 by using the special bolts 88. Therefore, the sealing performance can constantly be maintained without being affected by the removal of the spark plug 48, compared with the structure where the cover member 83 is gripped between the spark plug 48 and the cylinder head 18.

The pair of cover members 83, 83 arranged for the pair of respective adjacent cylinders C1, C2 are integrally joined to both the ends of the cylindrical connecting portion 90 forming the communicating passage 89 connecting between the oil jackets 81, 81 for both the cylinder C1, C2. In addition, the pair of cover members 83, 83 arranged for the pair of respective adjacent cylinders C3, C4 are integrally joined to both the ends of the cylindrical connecting portion 90 forming the communicating passage 89 connecting between the oil jackets 81, 81 for both the cylinder C3, C4. Thus, since the pair of cover members 83 are united with each other via the cylindrical connecting portion 90, the assembly man-hours can be reduced while also reducing the number of component parts required for assembling the engine.

Moreover, the cylinder head 18 has the first sidewall 30 bored with the intake ports 28 and the second sidewall 31 facing the side opposite the first sidewall 30 and bored with exhaust ports 29. The spark plug mounting holes 49 are provided in the cylinder head 18 so as to be disposed between the first and second sidewalls 30, 31. The connecting cylindrical portions 90 are disposed at a position offset from the center of the cover members 83 toward the first sidewall 30. Thus, it is possible to prevent (or minimize) the communicating passages 89 from being subjected to a thermal influence from the side of the exhaust port 29.

At least a portion of the plurality of cooling fins 97 is integrally formed on the cover member 83 at a portion overlapping the communicating passage 89, when viewed in a top view. Thus, oil flowing through the communicating passage 89 can effectively be cooled by the cooling fins 97.

The cooling fins 97 are each respectively disposed at an incline with respect to the front-rear direction of the motorcycle in such a manner as to take an outer position as it goes toward the rearward of the motorcycle, in the state where the engine body 15 is mounted on the motorcycle such that the cylinder arrangement direction 22 is oriented in a right-left direction.

Accordingly, during operation of the motorcycle, running-air flowing along the sides of the cooling fins 97 is allowed to flow along the external side of the engine body 15, thereby preventing or minimizing heat from staying in the central side of the engine body 15.

However, the cylinder head 18 of the engine body 15 having the in-line arranged first through fourth cylinders C1 to C4 and the forwardly inclined cylinder axes C of the cylinders C1 to C4 is formed with the oil jackets 81 for the respective cylinders C1 to C4. Oil discharged from the cooling oil pump 63 is supplied to the oil jackets 81 via the branch passage 122. The passage-forming member 123 forming the branch passage 122 separately from the engine body 15 is attached to the front surface of the cylinder block 17 of the engine body 15 so as to face the front side of the motorcycle. In this way, oil flowing through the branch passage 122 can be cooled by running-air. Thus, oil having relatively low temperature is supplied to the oil jackets 81 to thereby improve cooling performance.

The cylinder block 17 of the engine body 15 is provided with the pair of oil supply passages 126 communicating with the oil jackets 81 of the second and third cylinders C2, C3, respectively. The passage forming members 123 are attached at both ends to the cylinder block 17 in such that both the ends of the branch passage 122 communicate with both the oil supply passages 126. Thus, the passage-forming member 123 disposed on the front surface of the cylinder block 17 can be made short as much as possible to become inconspicuous.

The oil cooler 104 adapted to cool a portion of oil discharged from the cooling oil pump 63, and the oil cooling circuit 105 adapted to lead the oil cooled by the oil cooler 104 to the branch passage 122 are provided between the cooling oil pump 63 and the branch passage 122. Accordingly, oil is led to the branch passage 122 from the oil cooler 104 adapted to cool a portion of oil discharged from the cooling oil pump 63. Thus, temperature of oil supplied to the oil jackets 81 can further be lowered to additionally improve cooling performance.

The bypass circuit 106 adapted to bypass the oil cooling circuit 105 is provided between the cooling oil pump 63 and the branch passage 122. A flowing amount of oil discharged from the cooling oil pump 63 to the oil cooling circuit 105 and the bypass circuit 106 is controlled by the thermostat 107. The fifth oil pipe 125 (of the bypass circuit 106) projecting from the lateral surface of the crankcase 16 is connected from below (a lower portion) to the passage-forming member 12 continuously with the branch passage 122.

The third oil pipe 121 (of the oil cooling circuit 105), which leads oil from the oil cooler 104 is connected from above to the passage-forming member 123 continuously with the branch passage 122. Accordingly, the sealing surface between the fifth oil pipe 125 and the passage-forming member 123, and the sealing surface between the third oil pipe 121 and the passage-forming member 123 can be formed as a plane perpendicular to the axes of the fifth oil pipe 125 and of the third oil pipe 121. Thus, the sufficient sealing performance can be obtained without making the sealing surfaces complicated.

Additionally, the passage-forming member 123 is formed cylindrical so as to be closed at one end by the plug member 130, and the oil temperature sensor 131 for detecting the temperature of oil flowing through the branch passage 122 is attached to the passage-forming member 123 so as to close the other end of the passage-forming member 123.

Accordingly, the other end opening of the passage-forming member 123 can be closed using the oil temperature sensor 131. Thus, the use of the special plug member becomes unnecessary thereby reducing the number of component parts for the system.

The oil cooling circuit 105 having the oil cooler 104 for cooling oil discharged from the cooling oil pump 63 for pumping oil from the oil pan 20, and the bypass circuit 106 adapted to bypass the oil cooling circuit 105 are connected to the branch portion 103 attached to the cooling oil discharge pipe 102 communicating with the discharge port of the cooling oil pump 63, and are housed in the oil pan 20.

In addition, the thermostat 107 adapted to control the flow of oil discharged from the cooling oil pump 63 to the oil cooling circuit 105 and the bypass circuit 106 is disposed in the branch portion 103. Accordingly, the thermostat 107 is disposed in the oil pan 20 so that it becomes unnecessary to ensure the space adapted to dispose the thermostat externally of the engine body 15 and a member for protecting the thermostat 107 is not necessary. Thus, the thermostat 107 does not have an influence on the layout of the motorcycle in the state of being mounted on the motorcycle.

The thermostat housing case 108 constituting the branch portion 103 is provided continuously with the cooling oil discharge pipe 102 so as to fixedly house the thermostat 107 therein. Therefore, the thermostat housing case 108 is not exposed to the outside of the engine body 15. Thus, external appearance of the motorcycle is unlikely to degrade.

If the thermostat housing case 108 is close to the discharge side of the cooling oil pump 63, high sealing performance is usually required because of high discharge pressure. However, since the thermostat housing case 108 is housed in the oil pan 20, high sealing performance is not required. In other words, a thermostat housing case with ordinary performance can be used.

The thermostat housing case 108 is attached to the oil pan 20 at a lower portion. The connection pipe 112 extending in the direction of attaching and removing to and from the crankcase 16 of the engine body 15 and connecting with the cooling oil discharge pipe 102 is fitted to the upper portion of the thermostat housing case 108 in a liquid-tight manner.

Accordingly, the thermostat 107 can be replaced by removing the oil pan 20 from the crankcase 16. In addition, the oil pan 20 attached with the thermostat housing case 108 is attached to the crankcase 16 in order to fit the connection pipe 112 to the upper portion of the thermostat housing case 108. Thus, assembly work of the thermostat housing case 108 to the cooling oil discharge pipe 102 can be facilitated.

The upper portion of the relief valve 115 connected to the discharge port of the lubricating oil pump 64 is fitted from below to the crankcase 16 in a liquid-tight manner. In addition, the lower end of the relief valve 115 is abutted against and supported by the thermostat housing case 108 attached to the oil pan 20 joined to the bottom of the crankcase 16. Thus, since the relief valve 115 is supported by the thermostat housing case 108, a special support part is not required (i.e., can be made unnecessary) thereby reducing the number of component parts.

The splash suppression wall 109*b* adapted to suppress the splash of oil discharged from the relief valve 115 is integrally provided on the thermostat housing case 108 so as to surround at least a part of the outer circumference of the relief valve 115. Thus, the thermostat housing case 108 is also used as the splash suppression wall 109*b* thereby reducing the number of component parts required for forming the air-oil cooled engine.

Figure 16:
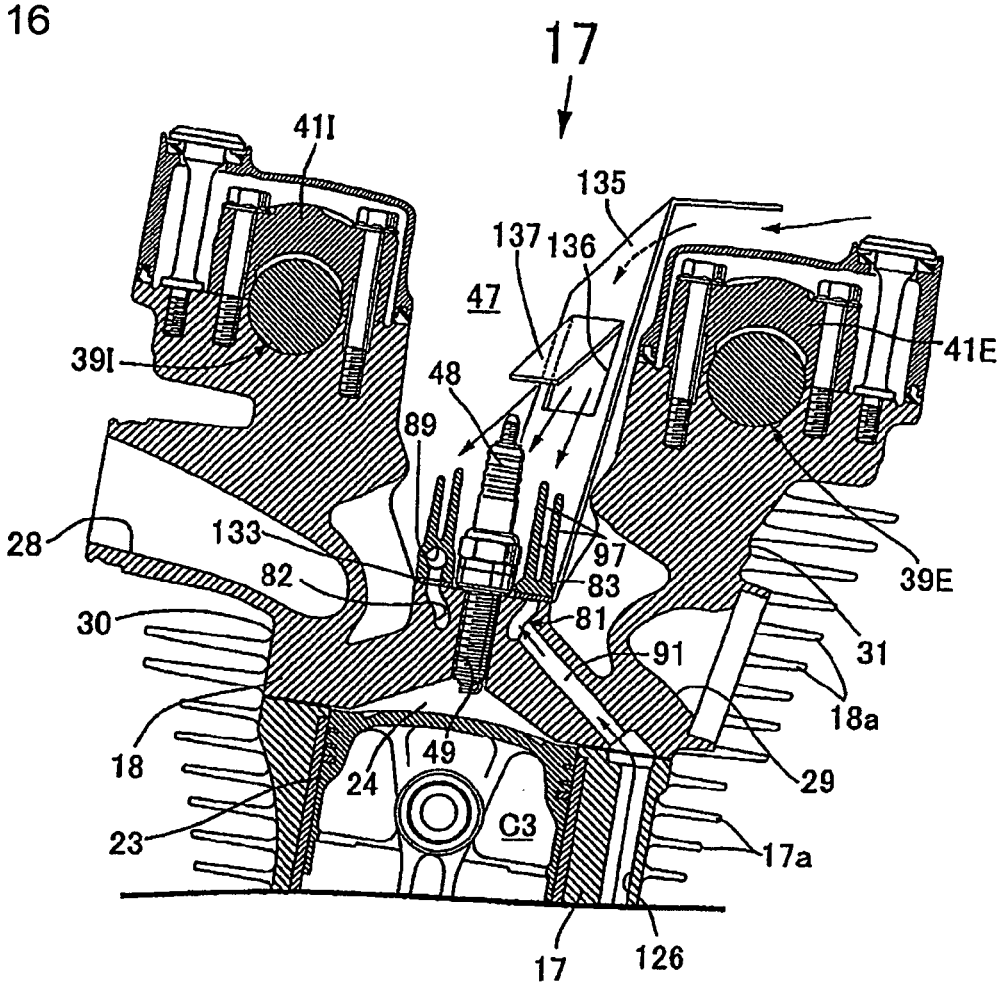
FIG. 16 is a longitudinal cross-sectional view of an upper portion of the engine body according to a second embodiment.
Figure 17:
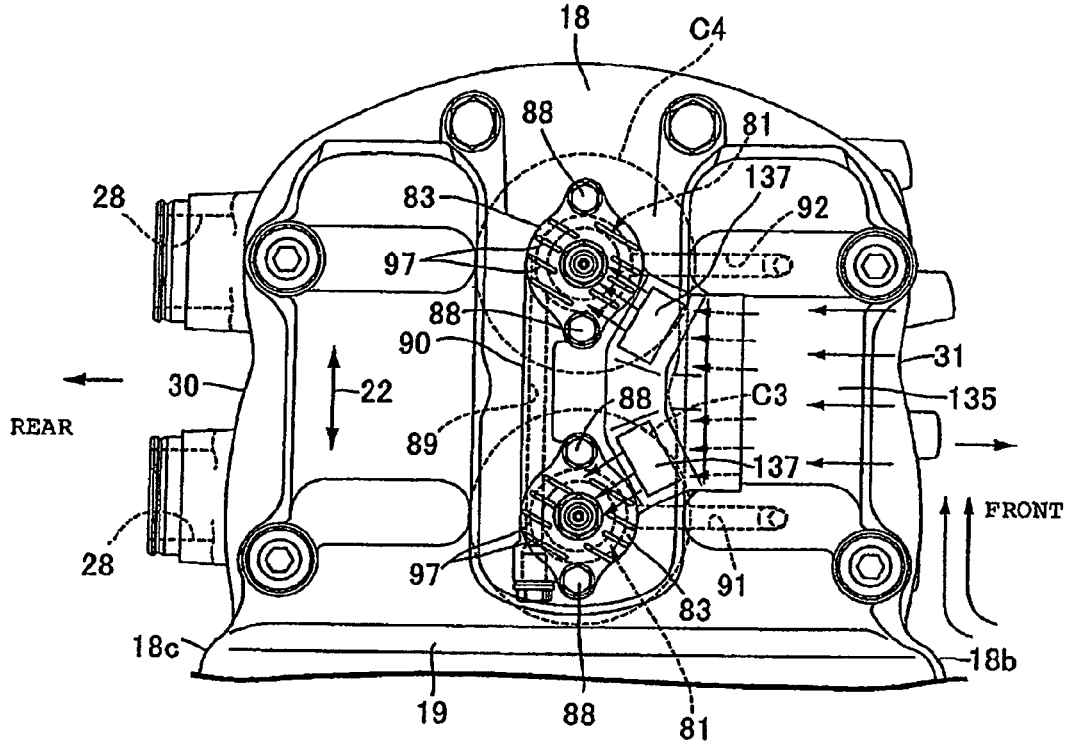
FIG. 17 is a view as viewed from direction of arrow 17 in FIG. 16.

FIGS. 16 and 17 illustrate a second embodiment of the present invention.

FIG. 16 is a longitudinal cross-sectional view of an upper portion of the engine body and FIG. 17 is a view as viewed from arrow 17 in FIG. 16.

It may be noted that portions corresponding to those of the first embodiment, as discussed herein, are illustrated and denoted with like reference numerals and their detailed explanations are omitted.

In the third and fourth cylinders C3, C4 adjacent to each other, gaskets 133 are each disposed between the cylinder head 18 and a corresponding one of a pair of cover members 83, 83 disposed in the respective plug attachment concave portions 47. The gaskets 133 are made of metal and formed integrally continuously with each other.

An air-guide plate 135 is installed integrally continuously with the gaskets 133 integrally continuous with each other so as to be located between the pair of cover members 83, 83. The air-guide plate 135 extends above the plug attachment concave portion 47 and toward the front. During operation of the vehicle, running air is led to the peripheries of the spark plugs 48 by the air-guide plate 135.

Further, there may be provided, at appropriate positions of the air-guide plate 135, windows 136 adapted to lead running-air toward the spark plugs 48 and widow roofs 137 adapted to lead air from the windows 136 toward the spark plugs 48. Also the first and second cylinders C1, C2 (see the first embodiment) may be configured similar to the third and fourth cylinders C3, C4.

According to the second embodiment, the gaskets 133 made of metal are formed integrally continuously with each other so as to be each interposed between a corresponding one of the pair of cover members 83 and the cylinder head 18. This contributes to a reduction in the number of component parts.

In addition, the seal members 133 are provided integrally with the air-guide plate 135 which extends above the plug attachment concave portion 47 and toward the front so as to lead running-air to the peripheries of the spark plugs 48. Thus, the spark plugs 48 and their peripheries can be cooled while avoiding an increase in the number of component parts.

Although the embodiments of the present invention have been described thus far, the present invention is not limited to the above embodiments but can be variously modified in design without departing from the scope of the invention as claimed.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A four-cycle air-oil cooled engine, comprising:

a cylinder head having a spark plug mounting hole formed therein and a groove formed therein surrounding a portion of the spark plug mounting hole; said spark plug mounting hole adapted to receive a tip portion of a spark plug therein;

a cover member operatively attached to said cylinder head and surrounding a portion of said spark plug mounting hole and arranged to cover an opening end of the groove, thereby defining an oil jacket around a periphery of the spark plug mounting hole; and a gasket disposed between said cylinder head and said cover member;

wherein the cylinder head is formed with first and second co-planar sealing surfaces which are disposed along a plane perpendicular to an axis of the spark plug mounting hole, wherein the opening end of the groove is disposed between the first flat sealing surface and the second flat sealing surface; and wherein said cover member, having a flat surface opposed to the first and second sealing surfaces, is secured to the cylinder head such that said gasket is interposed between the first and second sealing surfaces and the flat surface of the cover member.

2. The four-cycle air-oil cooled engine according to claim 1, wherein said cover member is fastened to the cylinder head by a fastening member.

3. The four-cycle air-oil cooled engine according to claim 1, wherein the engine comprises a plurality of cylinders arranged in pairs, and further comprising additional cover members; wherein a cylindrical connecting portion is integrally continuously provided at both ends with a pair of said cover members disposed for each pair of cylinders adjacent to each other, said cylindrical connecting portion forming a communicating passage between the oil jackets for each pair of cylinders.

4. The four-cycle air-oil cooled engine according to claim 2, wherein the engine comprises a plurality of cylinders arranged in pairs, and further comprising additional cover members; wherein a cylindrical connecting portion is integrally continuously provided at both ends with a pair of the cover members disposed for each pair of cylinders adjacent to each other, said cylindrical connecting portion forming a communicating passage between the oil jackets for each pair of cylinders.

5. The four-cycle air-oil cooled engine according to claim 3, wherein:

the cylinder head has a first sidewall having an intake port bored therein and a second sidewall having an exhaust port bored therein;

said second sidewall is situated opposite said first sidewall, said spark plug mounting hole is located between the first and second sidewalls, and the cylindrical connecting portion is disposed at a position offset from the center of the cover member toward the first sidewall.

6. The four-cycle air-oil cooled engine according to claim 4, the cylinder head has a first sidewall having an intake port bored therein and a second sidewall having an exhaust port bored therein; wherein said second sidewall is situated opposite to said first sidewall, and said spark plug mounting hole is located between the first and second sidewalls, the cylindrical connecting portion is disposed at a position offset from the center of the cover member toward the first sidewall.

7. The four-cycle air-oil cooled engine according to claim 3, further comprising a plurality of fins integrally formed on the cover members;

wherein at least a portion of said plurality of cooling fins is disposed at a portion overlapping the communicating passage, when viewed in a top view.

8. The four-cycle air-oil cooled engine according to claim 5, further comprising a plurality of fins integrally formed on the cover members;

wherein at least a portion of said plurality of cooling fins is disposed at a portion overlapping the communicating passage, when viewed in a top view.

9. The four-cycle air-oil cooled engine according to claim 7, wherein the cooling fins are each respectively disposed at an incline with respect to the front-rear direction of the vehicle such that an outer portions of the cooling fin is oriented rearwardly of the vehicle, in a state where the engine body is mounted on the vehicle, when a cylinder arrangement direction is oriented a right-left direction.

10. The four-cycle air-oil cooled engine according to claim 8, wherein the cooling fins are each respectively disposed at an incline with respect to the front-rear direction of the vehicle such that an outer portions of the cooling fin is oriented rearwardly of the vehicle, in a state where the engine body is mounted on the vehicle, when a cylinder arrangement direction is oriented a right-left direction.

11. The four-cycle air-oil cooled engine according to claim 3, further comprising an upper portion of the cylinder head and a head cover joined to the cylinder head having a plug attachment concave portion formed therein; wherein the plug attachment concave portion opens at least upwardly, and is adapted to receive a portion of the spark plug therein;

an air-guide plate adapted to lead running-air to the periphery of the spark plug during operation of a vehicle;

wherein said air-guide plate is formed integrally continuous with said gasket formed of material comprising one or more metal, said air-guide plate extending above the plug attachment concave portion and toward a front side of the vehicle; and wherein the gasket is interposed between the cylinder head and the pair of cover members disposed inside the plug attachment concave portion for each pair of cylinders adjacent to each other.

12. The four-cycle air-oil cooled engine according to claim 5, further comprising an upper portion of the cylinder head and a head cover joined to the cylinder head having a plug attachment concave portion formed therein; wherein the plug attachment concave portion opens at least upwardly, and is adapted to receive a portion of the spark plug therein;

an air-guide plate adapted to lead running-air to the periphery of the spark plug during operation of a vehicle;

wherein said air-guide plate is formed integrally continuous with said gasket formed of material comprising one or more metal, said air-guide plate extending above the plug attachment concave portion and toward a front side of the vehicle; and wherein the gasket is interposed between the cylinder head and the pair of cover members disposed inside the plug attachment concave portion for each pair of cylinders adjacent to each other.

13. The four-cycle air-oil cooled engine according to claim 7, further comprising an upper portion of the cylinder head and a head cover joined to the cylinder head having a plug attachment concave portion formed therein; wherein the plug attachment concave portion opens at least upwardly, and is adapted to receive a portion of the spark plug therein;

an air-guide plate adapted to lead running-air to the periphery of the spark plug during operation of a vehicle;

wherein said air-guide plate is formed integrally continuous with said gasket formed of material comprising one or more metals, said air-guide plate extending above the plug attachment concave portion and toward a front side of the vehicle; and wherein the gasket is interposed between the cylinder head and the pair of cover members disposed inside the plug attachment concave portion for each pair of cylinders adjacent to each other.

14. The four-cycle air-oil cooled engine according to claim 9, further comprising an upper portion of the cylinder head and a head cover joined to the cylinder head having a plug attachment concave portion formed therein; wherein the plug attachment concave portion opens at least upwardly, and is adapted to receive a portion of the spark plug therein;

an air-guide plate adapted to lead running-air to the periphery of the spark plug during operation of a vehicle;

wherein said air-guide plate is formed integrally continuous with said gasket formed of material comprising one or more metals, said air-guide plate extending above the plug attachment concave portion and toward a front side of the vehicle; and wherein the gasket is interposed between the cylinder head and the pair of cover members disposed inside the plug attachment concave portion for each pair of cylinders adjacent to each other.

15. A motorcycle comprising an air-oil cooled engine, said engine comprising a cylinder head having a spark plug mounting hole and a groove surrounding a portion of the spark plug mounting hole formed therein; said spark plug mounting hole adapted to receive a spark plug therein;

a cover member secured with said cylinder head surrounding a portion of said spark plug mounting hole such that an opening end of the groove is closed thereby defining an oil jacket around a periphery of the spark plug mounting hole; and a gasket disposed between said cylinder head and said cover member;

wherein the cylinder head is formed with a pair of flat sealing surfaces having a plane perpendicular to an axis of the spark plug mounting hole; wherein the opening end of the groove is formed between the pair of flat sealing surfaces; and wherein said cover member having a flat surface opposed to the pair of flat sealing surfaces is secured to the cylinder head such that said gasket is interposed between the pair of flat sealing surfaces and the flat surface of the cover member.

16. A motorcycle according to claim 15, wherein said cover member is fastened to the cylinder head by using a fastening member.

17. A motorcycle according to claim 15, wherein the engine comprises a plurality of cylinders arranged in pairs, and further comprising additional cover members; wherein a cylindrical connecting portion is integrally continuously provided at both ends with a pair of the cover members disposed for each pair of cylinders adjacent to each other, said cylindrical connecting portion forming a communicating passage between the oil jackets for each pair of cylinders.

18. An air-oil cooled engine, comprising a cylinder head having a spark plug mounting hole and a groove surrounding a portion of the spark plug mounting hole formed therein; said spark plug mounting hole adapted to receive a spark plug therein;

a cover member secured with said cylinder head surrounding a portion of said spark plug mounting hole such that an opening end of the groove is closed, thereby defining an oil jacket around a periphery of the spark plug mounting hole;

a gasket disposed between said cylinder head and said cover member; said gasket being formed of material comprising one or more metals;

an air-guide plate formed integrally continuous with said gasket, and extending upwardly of said spark plug towards a front side of the vehicle; said air-guide plate adapted to divert running-air to the periphery of the spark plug during operation of a vehicle;

wherein the cylinder head is formed with a pair of flat sealing surfaces having a plane perpendicular to an axis of the spark plug mounting hole; wherein the opening end of the groove is formed between the pair of flat sealing surfaces; and wherein said cover member having a flat surface opposed to the pair of flat sealing surfaces is secured to the cylinder head such that said gasket is interposed between the pair of flat sealing surfaces and the flat surface of the cover member.

19. An air-oil cooled engine according to claim 18, wherein the engine comprises a plurality of cylinders arranged in pairs, and further comprising additional cover members; wherein a cylindrical connecting portion is integrally continuously provided at both ends with a pair of the cover members disposed for each pair of cylinders adjacent to each other, said cylindrical connecting portion forming a communicating passage between the oil jackets for each pair of cylinders.

20. An air-oil cooled engine according to claim 19, wherein the cylinder head has a first sidewall having an intake port bored therein and a second sidewall having an exhaust port bored therein; wherein said second sidewall is situated opposite to said first sidewall, and said spark plug mounting hole is located between the first and second sidewalls, the cylindrical connecting portion is disposed at a position offset from the center of the cover member toward the first sidewall.

* * * * *